US011346107B2

(12) United States Patent
Matsuno

(10) Patent No.: US 11,346,107 B2
(45) Date of Patent: May 31, 2022

(54) REBAR TYING TOOL

(71) Applicant: MAKITA CORPORATION, Anjo (JP)

(72) Inventor: Tadasuke Matsuno, Anjo (JP)

(73) Assignee: MAKITA CORPORATION, Anjo (JP)

( * ) Notice: Subject to any disclaimer, the term of this patent is extended or adjusted under 35 U.S.C. 154(b) by 286 days.

(21) Appl. No.: 16/739,321

(22) Filed: Jan. 10, 2020

(65) Prior Publication Data

US 2020/0149279 A1 May 14, 2020

Related U.S. Application Data

(63) Continuation of application No. 15/404,822, filed on Jan. 12, 2017, now Pat. No. 10,570,620.

(30) Foreign Application Priority Data

Jan. 28, 2016 (JP) ..... 2016-014275

(51) Int. Cl.
*E04G 21/12* (2006.01)
*E04C 5/16* (2006.01)
(Continued)

(52) U.S. Cl.
CPC ..... *E04C 5/166* (2013.01); *B21F 15/04* (2013.01); *E04G 21/123* (2013.01); *E04G 21/16* (2013.01)

(58) Field of Classification Search
CPC ..... E04G 21/122; E04G 21/123; B65B 13/04; B65B 13/28; B65B 13/285; B21F 7/00; B21F 15/04; B21F 45/006
See application file for complete search history.

(56) References Cited

U.S. PATENT DOCUMENTS 5,279,336 A * 1/1994 Kusakari ..... E04G 21/123 140/57
5,682,927 A * 11/1997 Takahashi ..... B65B 27/10 140/119
(Continued)

FOREIGN PATENT DOCUMENTS

JP H09-156608 A 6/1997
JP H10-250703 A 9/1998
(Continued)

OTHER PUBLICATIONS

Max USA Corp. Tools, Max USA Corp.—Twintier RB441T, Product Introduction, Jan. 19, 2018, https://www.youtube.com/watch?v=QiXjdiEG47I&t=74s (Year: 2018).*
(Continued)

*Primary Examiner* — Matthew Katcoff
(74) *Attorney, Agent, or Firm* — Oliff PLC

(57) ABSTRACT

The disclosure herein discloses a rebar tying tool that ties plural rebars using a wire. The rebar tying tool includes a housing and a twisting motor, and may include a twisting mechanism that twists the wire around the plural rebars by the twisting motor. The twisting mechanism may include a screw shaft, a gripping member that grips the wire in cooperation with rotation of the screw shaft, a first reduction mechanism that reduces and transmits rotation of the twisting motor to a relay shaft, and a second reduction mechanism that reduces and transmits rotation of the relay shaft to the screw shaft. The first reduction mechanism may be a coaxial reduction mechanism, and the second reduction mechanism may be a parallel-axis reduction mechanism.

15 Claims, 27 Drawing Sheets

(51) Int. Cl.
*B21F 15/04* (2006.01)
*E04G 21/16* (2006.01)

(56) References Cited

U.S. PATENT DOCUMENTS

| | | | | |
|---|---|---|---|---|
| 7,817,053 | B2 | 10/2010 | Kusakari et al. | |
| 8,397,767 | B2 * | 3/2013 | Nagaoka | B25B 25/00 140/93 R |
| 9,004,114 | B2 * | 4/2015 | Kasahara | E04G 21/123 140/93.6 |
| 9,132,472 | B2 * | 9/2015 | Itagaki | B65H 59/04 |
| 10,443,252 | B2 * | 10/2019 | Lu | E04G 21/123 |
| 11,123,788 | B2 * | 9/2021 | Kasahara | B21F 15/04 |
| 2008/0110354 | A1 * | 5/2008 | Itagaki | E04G 21/122 100/31 |
| 2009/0283171 | A1 | 11/2009 | Nagaoka et al. | |
| 2009/0283172 | A1 | 11/2009 | Itagaki | |
| 2014/0246115 | A1 | 9/2014 | Itagaki | |
| 2015/0048194 | A1 | 2/2015 | Itagaki | |
| 2015/0232212 | A1 | 8/2015 | Itagaki | |
| 2016/0108632 | A1 | 4/2016 | Lu | |
| 2016/0186451 | A1 | 6/2016 | Itagaki | |
| 2016/0297555 | A1 | 10/2016 | Itagaki | |
| 2017/0305584 | A1 | 10/2017 | Itagaki | |
| 2018/0207710 | A1 * | 7/2018 | Itagaki | B21F 7/00 |
| 2019/0002139 | A1 | 1/2019 | Itagaki | |

FOREIGN PATENT DOCUMENTS

| | | | |
|---|---|---|---|
| JP | 2010-01731 | A | 1/2010 |
| JP | 2010-185184 | A | 8/2010 |
| JP | 2014-231142 | A | 12/2014 |
| WO | 2014/186927 | A1 | 11/2014 |

OTHER PUBLICATIONS

Aug. 20, 2019 Office Action issued in Japanese Patent Application No. 2016-014275.

Nov. 26, 2019 Office Action issued in Japanese Patent Application No. 2016-014275.

* cited by examiner

REBAR TYING TOOL

This is a Continuation of application Ser. No. 15/404,822 filed Jan. 12, 2017, which claims the benefit of Japanese Patent Application No. 2016-014275, filed Jan. 28, 2016, which discloses a rebar tying tool that ties plural rebars using a wire.

TECHNICAL FIELD

A technique disclosed herein relates to a rebar tying tool.

BACKGROUND ART

The rebar tying tool is provided with a housing, a feeding mechanism that feeds the wire by rotation of a feeding motor from a reel on which the wire is wound, a guide mechanism that guides the wire fed from the feeding mechanism around the plural rebars, a cutting mechanism that cuts the wire fed from the feeding mechanism, and a twisting mechanism that twists the wire around the plural rebars by rotation of a twisting motor.

SUMMARY

The present disclosure aims to provide an improved rebar tying tool.

The disclosure herein discloses a rebar tying tool configured to tie plural rebars using a wire. The rebar tying tool may comprise a housing and a twisting mechanism provided with a twisting motor and configured to twist the wire around the plural rebars by the twisting motor. The twisting mechanism may further comprise a screw shaft, a gripping member configured to grip the wire in cooperation with rotation of the screw shaft, a first reduction mechanism configured to reduce and transmit rotation of the twisting motor to a relay shaft, and a second reduction mechanism configured to reduce and transmit rotation of the relay shaft to the screw shaft. The first reduction mechanism may be a coaxial reduction mechanism, and the second reduction mechanism may be a parallel-axis reduction mechanism. Notably, the coaxial reduction mechanism described herein refers to a reduction mechanism in which an input shaft and an output shaft are disposed on a same line, and for example, it may be a planetary gear mechanism or the like. Further, the parallel-axis reduction mechanism described herein refers to a reduction mechanism in which an input shaft and an output shaft are respectively disposed on lines that are parallel to each other, and for example, it may be a spur gear reduction mechanism, a helical gear-type reduction mechanism, a belt-type reduction mechanism, or the like.

A portion in a vicinity of a rear end of the screw shaft comes to be positioned in a vicinity of a center of a body portion of the rebar tying tool. Due to this, if the coaxial reduction mechanism is used as the second reduction mechanism for transmitting the rotation to the screw shaft, the coaxial reduction mechanism a size of which is large must be disposed in the vicinity of the center of the body portion of the rebar tying tool, which casts large restriction on an internal layout of the rebar tying tool. According to the above configuration, the parallel-axis reduction mechanism a size of which is small is used as the second reduction mechanism for transmitting the rotation to the screw shaft. Further, in the above configuration, the large-sized coaxial reduction mechanism is disposed at a position offset from a central portion by the parallel axis reduction mechanism. Due to this, a space in the vicinity of the center of the body portion of the rebar tying tool can be secured, and a degree of freedom in the internal layout of the rebar tying tool can be improved.

Another rebar tying tool disclosed herein comprises a reel on which a wire is wound, and a feeding motor configured to feed the wire, wherein the rebar tying tool is configured to tie plural rebars using the wire by feeding the wire from the reel by the feeding motor, guiding the wire around the plural rebars, and twisting the wire around the plural rebars. The rebar tying tool may comprise a first housing plate, and a second housing plate configuring an outer surface of the rebar tying tool and covering the reel and the feeding motor. The reel and the feeding motor are disposed between the first housing plate and the second housing plate.

In the above rebar tying tool, the rebar tying tool can be completed by assembling the reel and the feeding motor on the first housing, after which the second housing is assembled thereon. An assembly workability of the rebar tying tool can be improved as compared to a case of covering the reel and the feeding motor respectively by separated housing plates.

Yet another rebar tying tool disclosed herein comprises a feeding motor configured to feed a wire, and a twisting motor configured to twist the wire, wherein the rebar tying tool is configured to tie plural rebars using the wire by feeding the wire by the feeding motor, guiding the wire around the plural rebars, and twisting the wire around the plural rebars by the twisting motor. The rebar tying tool comprises a housing plate, and a control board configured to control the feeding motor and the twisting motor. The feeding motor is disposed on one side as seen from the housing plate. The twisting motor is disposed on the other side as seen from the housing plate. A part of the control board is disposed on the one side as seen from the housing plate, and another part of the control board is disposed on the other side as seen from the housing plate.

In the above rebar tying tool, a wire connection between the feeding motor and the control board can be performed in a space on the one side as seen from the housing plate, and a wire connection between the twisting motor and the control board can be performed in a space on the other side as seen from the housing plate. Since no connection wire needs to be passed from the one side to the other side of the housing plate, no hole and no connection terminal for passing the connection wire needs to be provided. Further, since the connection wire does not need to be passed from the one side to the other side of the housing plate, the assembly workability of the rebar tying tool can be improved.

Yet another rebar tying tool disclosed herein comprises a twisting motor configured to twist a wire, wherein the rebar tying tool is configured to tie plural rebars using the wire by feeding the wire, guiding the wire around the plural rebars, and twisting the wire around the plural rebars by the twisting motor. The rebar tying tool comprises a housing plate, a brake mechanism configured to brake the wire feeding, and a control board configured to control the brake mechanism and the twisting motor. The brake mechanism is disposed on one side as seen from the housing plate. The twisting motor is disposed on the other side as seen from the housing plate. A part of the control board is disposed on the one side as seen from the housing plate, and another part of the control board is disposed on the other side as seen from the housing plate.

In the above rebar tying tool, a wire connection between the brake mechanism and the control board can be performed in a space on the one side as seen from the housing plate, and a wire connection between the twisting motor and the control board can be performed in a space on the other side as seen from the housing plate. Since no connection wire needs to be passed from the one side to the other side of the housing plate, no hole and no connection terminal for passing the connection wire needs to be provided. Further, since the connection wire does not need to be passed from the one side to the other side of the housing plate, the assembly workability of the rebar tying tool can be improved.

DETAILED DESCRIPTION

Figure 1:
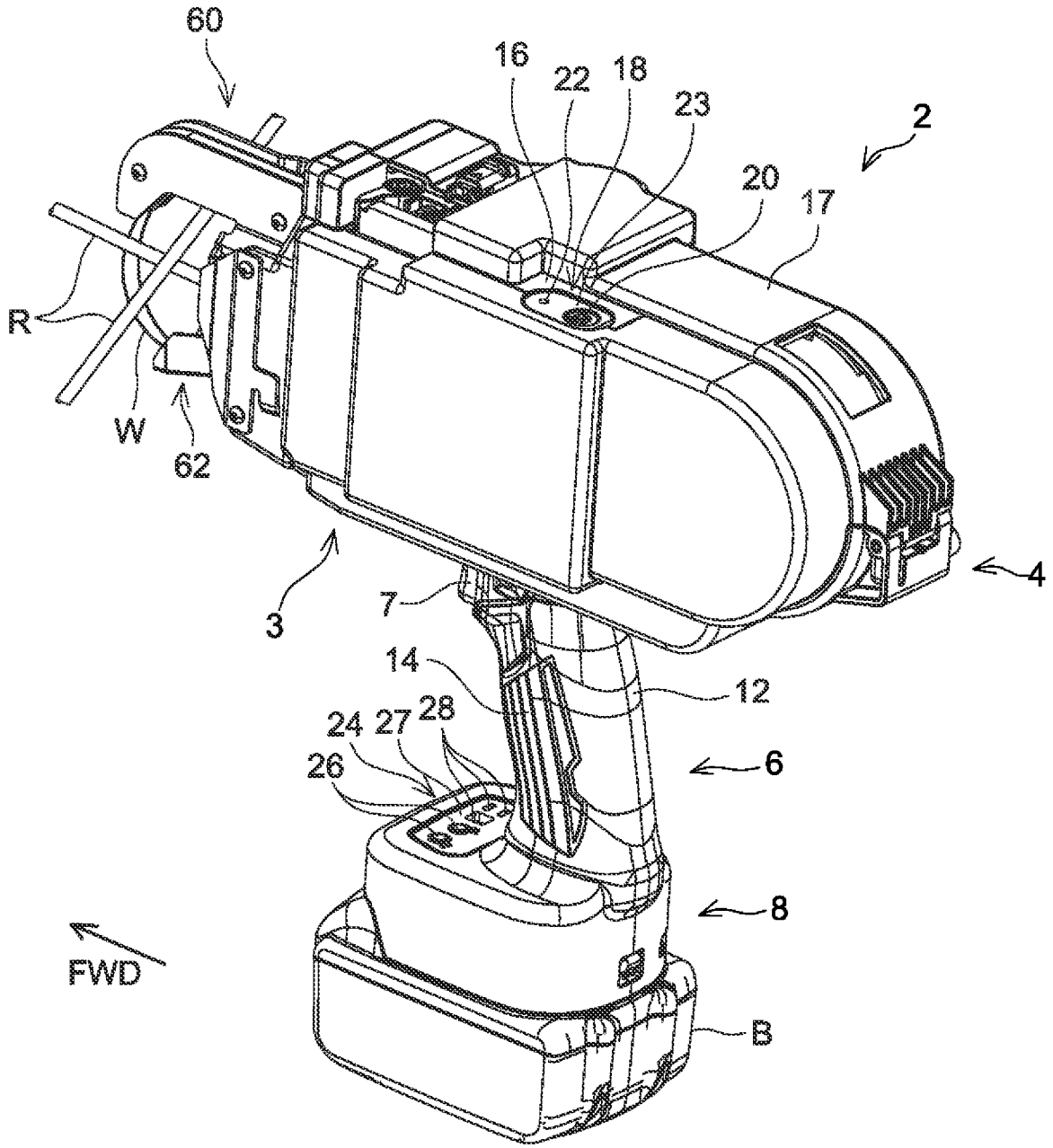
FIG. 1 is a perspective view showing an outer appearance of a rebar tying tool 2 of an embodiment.

In one or more embodiments, a twisting mechanism may be unitized.

According to the above configuration, the twisting mechanism can easily be installed upon assembling a rebar tying tool.

In one or more embodiments, the twisting mechanism may further comprise a distal shaft coupled with a gripping member via a cam mechanism; a sleeve coupled with a screw shaft via a rotary-linear motion converting mechanism, and into a front end side of which the distal shaft is inserted and into a rear end side of which the screw shaft is inserted; and a bumper disposed between the distal shaft and the screw shaft inside the sleeve.

According to the above configuration, as compared to a configuration in which the bumper is disposed on the rear end side of the sleeve, a size of the twisting mechanism in a vicinity of a rear end of the screw shaft can be made small. Due to this, a degree of freedom in a layout in a vicinity of a center of a body portion of the rebar tying tool can be improved.

In one or more embodiments, the rotary-linear motion converting mechanism may be a ball screw mechanism.

According to the above configuration, rotary motion of the screw shaft can be converted to linear motion by an inexpensive configuration.

In one or more embodiments, the rebar tying tool may further comprise a feeding mechanism provided with a feeding motor, and configured to feed a wire using the feeding motor from a reel on which the wire is wound; and a brake mechanism configured to stop rotation of the reel. The brake mechanism may comprise a brake arm configured to engage with the reel; an actuator; and a link coupling the brake arm and the actuator. The brake mechanism may be unitized.

According to the above configuration, the brake mechanism can easily be installed upon assembling the rebar tying tool.

In one or more embodiments, the reel may be disposed inside a reel chamber of a housing, the brake mechanism may be disposed inside a brake chamber of the housing, a wall of the housing defining the reel chamber may comprise a brake opening through which the brake arm passes, and the brake chamber may communicate with outside of the brake chamber only through the brake opening.

According to the above configuration, foreign matter can be suppressed from entering into the brake chamber. The brake mechanism and other mechanisms existing around the brake mechanism can be prevented from being affected by the foreign matter.

In one or more embodiments, the actuator may be disposed behind the feeding motor but in front of the reel, and the feeding motor, the actuator, and the reel may be disposed so as to overlap with each other in a front-and-rear direction.

According to the above configuration, the actuator of the brake mechanism is disposed in a dead space formed when the feeding motor and the reel are disposed along the front-and-rear direction, and thus the rebar tying tool can be made smaller in size.

In one or more embodiments, the rebar tying tool may further comprise a feeding mechanism provided with a feeding motor, and configured to feed a wire using the feeding motor from a reel on which the wire is wound. The housing may comprise a first outer housing; a second outer housing; and an inner housing disposed to be intervened between the first outer housing and the second outer housing. A twisting motor may be disposed in a space defined by the first outer housing and the inner housing, the feeding motor may be disposed in a space defined by the inner housing and the second outer housing, a twisting motor retaining portion configured to retain the twisting motor may be provided on a surface of the first outer housing facing the inner housing, and a feeding motor retaining portion configured to retain the feeding motor may be provided on a surface of the inner housing facing the second outer housing.

According to the above configuration, the twisting motor of the twisting mechanism is retained by the twisting motor retaining portion of the first outer housing and disposed in the space defined by the first outer housing and the inner housing, and the feeding motor of the feeding mechanism is retained by the feeding motor retaining portion of the inner housing and disposed in the space defined by the inner housing and the second outer housing. Upon assembling the rebar tying tool with the above configuration, firstly the twisting mechanism is installed onto the first outer housing, subsequently the inner housing is installed thereon, subsequently the feeding mechanism is installed onto the inner housing, and subsequently the second outer housing is installed thereon. According to the above configuration, the twisting mechanism including the twisting motor and the feeding mechanism including the feeding motor can both be installed by work from one side (that is, a second outer housing side) of the rebar tying tool. Due to this, assembling workability of the rebar tying tool can further be improved.

In one or more embodiments, the rebar tying tool may further comprise a guide mechanism configured to guide the wire around plural rebars. The guide mechanism may comprise an upper curl guide configured to guide the wire above the plural rebars; and a lower curl guide configured to guide the wire under the plural rebars such that the wire is guided into the lower curl guide from the upper curl guide. The lower curl guide may be openably supported on the housing. The rebar tying tool may further comprise a state detecting mechanism configured to detect whether a state of the lower curl guide is opened or closed. The state detection mechanism may comprise a contact piece, and may be configured to detect whether the state of the lower curl guide is opened or closed by detecting a contact between the contact piece and the lower curl guide. The housing may be provided with a state detection opening through which the contact piece passes, and a width of the state detection opening may be substantially equal to a width of the contact piece.

According to the above configuration, the state detection opening that needs to be provided on the housing to detect whether the state of the lower curl guide is opened or closed can be made as small as possible. Due to this, foreign matter can be prevented from entering through the state detection opening into an inside of the rebar tying tool.

Representative non-limiting examples of the present disclosure will now be described in further detail with reference to the attached drawings. This detailed description is merely intended to teach a person of skill in the art further details for practicing preferred aspects of the present teachings and is not intended to limit the scope of the disclosure. Furthermore, each of the additional features and teachings disclosed below may be utilized separately or in conjunction with other features and teachings to provide further improved rebar tying tools, as well as methods of using and manufacturing the same.

Moreover, combinations of features and steps disclosed in the following detailed description may not be necessary to practice the present disclosure in the broadest sense, and are instead taught merely to particularly describe representative examples of the disclosure. Furthermore, various features of the above-described and below-described representative examples, as well as various features of independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Embodiment

A rebar tying tool 2 of an embodiment will be described with reference to the drawings. The rebar tying tool 2 shown in FIG. 1 is a power tool for tying plural rebars R using a wire W.

The rebar tying tool 2 comprises a tying tool body 4, a grip 6 provided below the tying tool body 4, and a battery attachment 8 provided below the grip 6. A trigger 7 is provided at a front upper portion of the grip 6. A battery B is detachably attached below the battery attachment 8 via a terminal 9 (see FIGS. 24 to 27).

The rebar tying tool 2 comprises a housing 3. The housing 3 comprises a right outer housing 12, a left outer housing 14, and an inner housing 16. The right outer housing 12 is integrally structured with a right half surface of the tying tool body 4, a right half surface of the grip 6, and a right half surface of the battery attachment 8. The left outer housing 14 is integrally structured with a left half surface of the tying tool body 4, a left half surface of the grip 6, and a left half surface of the battery attachment 8. The right outer housing 12 and the left outer housing 14 configure an outer surface of the rebar tying tool 2. The inner housing 16 is configured in a shape that intervenes between the right outer housing 12 and the left outer housing 14 in an area from an upper portion to an intermediate portion of an inside of the tying tool body 4. Each of the right outer housing 12, the left outer housing 14, and the inner housing 16 can be termed a housing plate. The inside of the tying tool body 4 is partitioned into a space defined by the left outer housing 14 and the inner housing 16, and a space defined by the right outer housing 12 and the inner housing 16. The space defined by the left outer housing 14 and the inner housing 16 and the space defined by the right outer housing 12 and the inner housing 16 communicate at a lower portion of the tying tool body 4. Further, a reel chamber 19 that houses a reel 10 (see FIG. 2) is provided on a rear side of the tying tool body 4. The reel chamber 19 is defined, in its rightward direction, by the right outer housing 12, and is defined, in its leftward, downward, and forward directions, by the inner housing 16. The reel chamber 19 is covered, in its upward direction, by an openable cover 17.

A first operation and display unit 18 is provided on an upper surface of the tying tool body 4. The first operation and display unit 18 comprises a first operation and display unit board 21 (see FIGS. 5, 24, and 25) provided with a main switch 20 for switching power of the rebar tying tool 2 between on and off and a main power LED 22 for displaying an on/off state of the power of the rebar tying tool 2, and a first switch plate 23 that covers the main switch 20 and the main power LED 22 of the first operation and display unit board 21. A second operation and display unit 24 is provided on a front upper surface of the battery attachment 8. The second operation and display unit 24 comprises a second operation and display unit board 25 (see FIGS. 24 to 27) provided with setting buttons 26 for setting a feed amount of the wire W and twisting strength for the wire W and a display 28 for displaying contents set by the setting buttons 26, and a second switch plate 27 that covers the setting buttons 26 and the display 28 of the second operation and display unit board 25. The terminal 9 to which the battery B is connected, the trigger 7, the first operation and display unit board 21, and the second operation and display unit board 25 are connected to a control board 180 to be described later.

Figure 2:
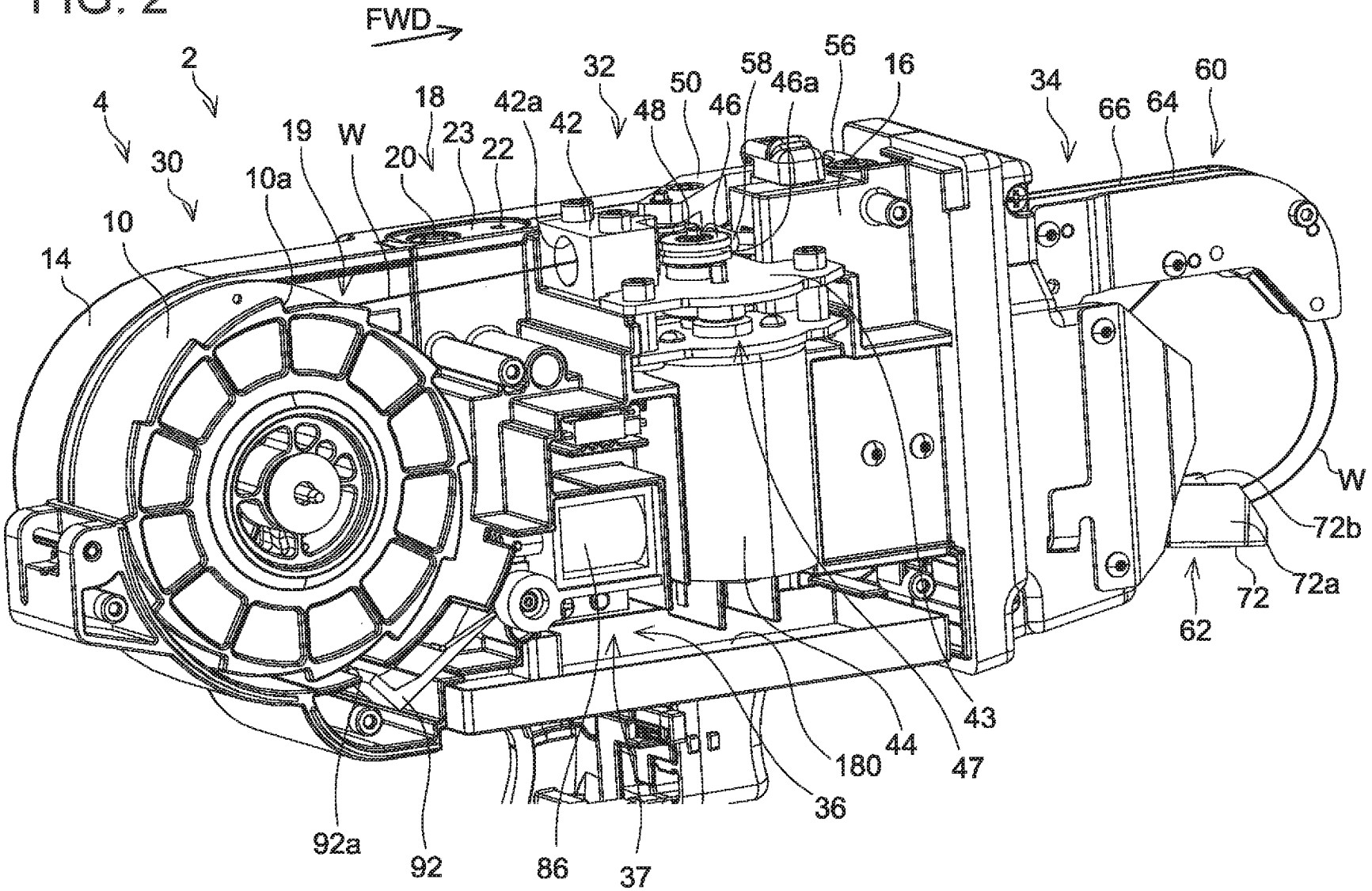
FIG. 2 is a perspective view showing an internal structure of a tying tool body 4 of the rebar tying tool 2 of the embodiment.
Figure 4:
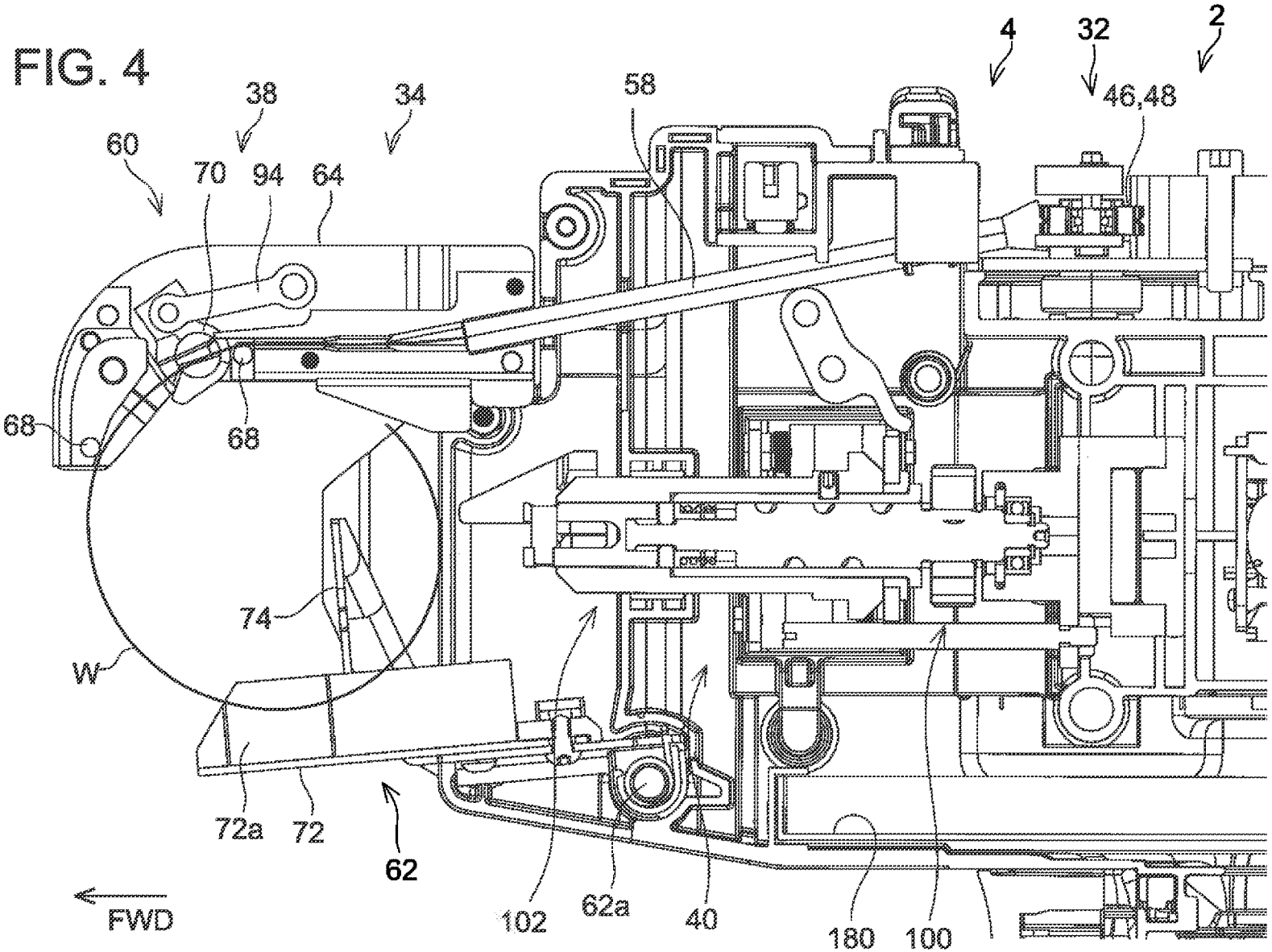
FIG. 4 is a cross sectional view showing the internal structure of the tying tool body 4 of the rebar tying tool 2 of the embodiment.
Figure 5:
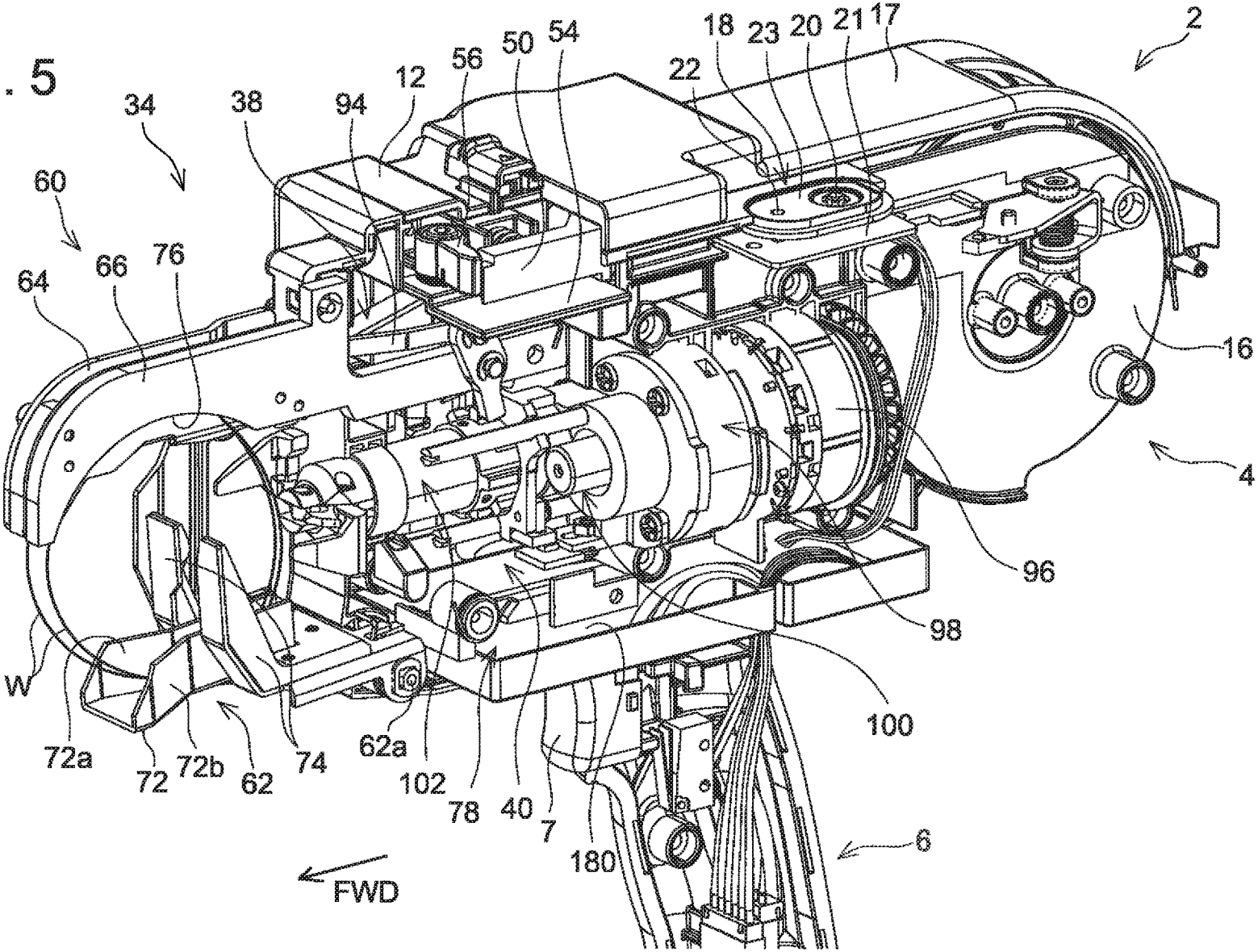
FIG. 5 is a perspective view showing the internal structures of the tying tool body 4 and a grip 6 of the rebar tying tool 2 of the embodiment.

The tying tool body 4 mainly comprises an accommodating mechanism 30, a feeding mechanism 32, a guide mechanism 34, a brake mechanism 36, and the control board 180 shown in FIG. 2, a cutting mechanism 38 shown in FIG. 4, and a twisting mechanism 40 shown in FIG. 5. Notably, in FIG. 2, the right outer housing 12, the cover 17, and connection wires and the like inside the rebar tying tool 2 are not shown for easier view of the drawing. For the same purpose, in FIG. 4, the connection wires inside the rebar tying tool 2 are not shown. Further, for the same purpose, in FIG. 5, the left outer housing 14 and a part of the connection wires inside the rebar tying tool 2 are not shown. The control board 180 is disposed at a lower center portion of the tying tool body 4 so as to extend across the inner housing 16. A part of the control board 180 is disposed on one side as seen from the inner housing 16 (right outer housing 12 side), and another part of the control board 180 is disposed on the other side as seen from the inner housing 16 (left outer housing 14 side).

As shown in FIG. 2, the accommodating mechanism 30 detachably retains the reel 10 on which the wire W is wound. The reel 10 is rotatably supported by the accommodating mechanism 30 in the reel chamber 19.

Figure 3:
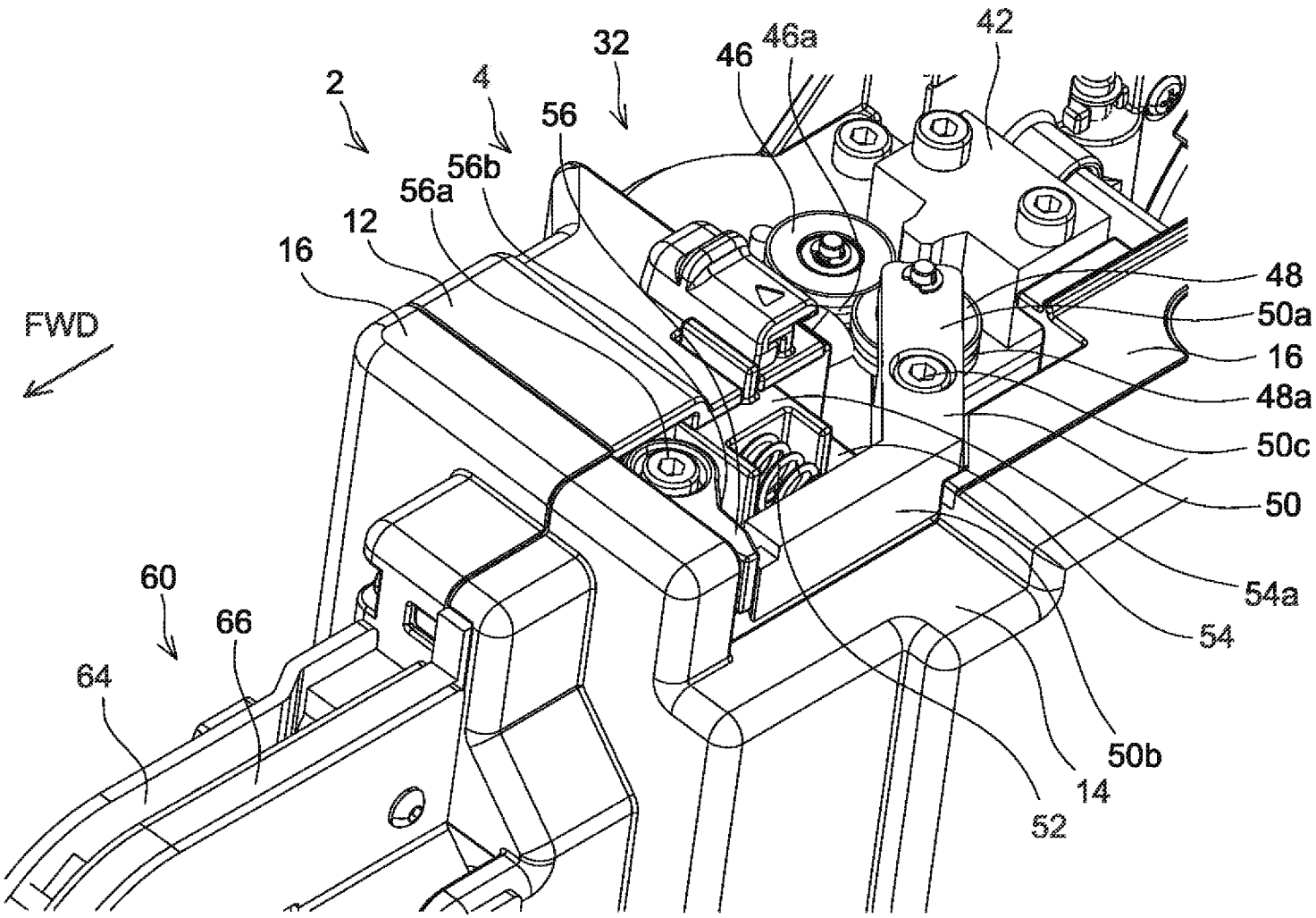
FIG. 3 is a perspective view showing an outer appearance of a feeding mechanism 32 of the rebar tying tool 2 of the embodiment.

The feeding mechanism 32 feeds out the wire W supplied from the reel 10 in the accommodating mechanism 30 to the guide mechanism 34 located on a front side of the tying tool body 4. The feeding mechanism 32 comprises a guiding member 42, a base member 43, a feeding motor 44, a driving gear 46, a reduction mechanism 47, a driven gear 48, a releasing lever 50, a compression spring 52 (see FIG. 3), a lever holder 54 (see FIG. 3), and a lock lever 56. The feeding mechanism 32 is unitized, and is attached to the inner housing 16. The guiding member 42 comprises a tapered penetrating hole 42*a* having a wide rear end and a narrow tip end. The guiding member 42 is fixed to the base member 43. The driving gear 46 and the driven gear 48 are disposed more forward than the guiding member 42. The driving gear 46 is coupled to the feeding motor 44 via the reduction mechanism 47, and is rotated by being driven by the feeding motor 44. The feeding motor 44 is connected to the control board 180 by the connection wire (not shown). The control board 180 is configured to control an operation of the feeding motor 44. On a lateral surface of the driving gear 46, a V-shaped groove 46*a* which extends along a circumferential direction of the driving gear 46 at a center in its height direction is provided. As shown in FIG. 3, the driven gear 48 is rotatably supported by a gear arm 50*a* of the releasing lever 50. On a lateral surface of the driven gear 48, a V-shaped groove 48*a* which extends along a circumferential direction of the driven gear 48 at a center in its height direction is provided. The releasing lever 50 is a substantially L-shaped member that comprises the gear arm 50*a* and an operation arm 50*b*. The releasing lever 50 is pivotaly supported by the base member 43 via a pivot shaft 50*c*. The operation arm 50*b* of the releasing lever 50 is coupled to a spring receiving portion 54*a* of the lever holder 54 via the compression spring 52. The lever holder 54 is fixed by being clamped between the inner housing 16 and the left outer housing 14. The compression spring 52 biases the operation arm 50*b* in a direction away from the spring receiving portion 54*a*. Normally, torque acting in a direction that causes the driven gear 48 to approach the driving gear 46 is applied to the releasing lever 50 by biasing force of the compression spring 52, and the driven gear 48 is pressed against the driving gear 46. Due to this, teeth on the lateral surface of the driven gear 48 and teeth on the lateral surface of the driving gear 46 are engaged, and the wire W is held between the V-shaped groove 46*a* of the driving gear 46 and the V-shaped groove 48*a* of the driven gear 48. When the feeding motor 44 rotates the driving gear 46 in this state, the driven gear 48 rotates in an opposite direction to the rotation direction of the driving gear 46, and the wire W held by the driving gear 46 and the driven gear 48 is fed out to the guide mechanism 34, and thus the wire W is drawn out from the reel 10.

The lock lever 56 is pivotaly supported by the lever holder 54 via a pivot shaft 56*a*. The lock lever 56 is biased in a direction along which the lock lever 56 contacts with the operation arm 50*b* of the releasing lever 50 by a torsion spring that is not shown. On the lock lever 56, a recess 56*b* that engages with an tip of the operation arm 50*b* of the releasing lever 50 is provided.

When a user of the rebar tying tool 2 presses in the operation arm 50*b* against the biasing force of the compression spring 52, the releasing lever 50 pivots about the pivot shaft 50*c* and the driven gear 48 separates from the driving gear 46. At this occasion, the lock lever 56 pivots about the pivot shaft 56*a* and the end portion of the operation arm 50*b* engages with the recess 56*b*, resulting in the operation arm 50*b* being retained in the pressed-in state. Upon setting the wire W extending from the reel 10 in the feeding mechanism 32, the user presses in the operation arm 50*b* to separate the driven gear 48 from the driving gear 46, and in that state, positions an end of the wire W drawn out from the reel 10 between the driving gear 46 and the driven gear 48 through the penetrating hole 42*a* of the guiding member 42. Then, when the user pivots the lock lever 56 in a direction along which the lock lever 56 separates away from the operation arm 50*b*, the releasing lever 50 pivots about the pivot shaft 50*c* and the driven gear 48 engages with the driving gear 46, and the wire W is held between the V-shaped groove 46*a* of the driving gear 46 and the V-shaped groove 48*a* of the driven gear 48.

As shown in FIGS. 4 and 5, the guide mechanism 34 guides the wire W fed from the feeding mechanism 32 around the rebars R in a circular shape. The guide mechanism 34 comprises a guiding pipe 58, an upper curl guide 60, and a lower curl guide 62. The guiding pipe 58 and the upper curl guide 60 are unitized, and are attached to front sides of the left outer housing 14 and the inner housing 16. A rearward end portion of the guiding pipe 58 is open toward an interface between the driving gear 46 and the driven gear 48. The wire W fed from the feeding mechanism 32 is fed into the guiding pipe 58. A forward end portion of the guiding pipe 58 is open toward an inside of the upper curl guide 60. The upper curl guide 60 is provided with a first guiding passage 64 for guiding the wire W fed from the guiding pipe 58, and a second guiding passage 66 for guiding the wire W fed from the lower curl guide 62.

As shown in FIG. 4, the first guiding passage 64 is provided with a plurality of guiding pins 68 for guiding the wire W so as to provide a downward curving profile to the wire W, and a cutter 70 constituting a part of the cutting mechanism 38 to be described later. The wire W fed from the guiding pipe 58 is guided by the guiding pins 68 in the first guiding passage 64, passes through the cutter 70, and is fed out from a forward end of the upper curl guide 60 toward the lower curl guide 62.

As shown in FIG. 5, the lower curl guide 62 is provided with a third guiding passage 72 and guarding plates 74. The third guiding passage 72 comprises a right-side guiding wall 72*a* and a left-side guiding wall 72*b* for guiding the wire W fed from the forward end of the upper curl guide 60. The guarding plates 74 have a shape extending upward on both sides of the third guiding passage 72, and prevent the plural rebars R from interfering with the twisting mechanism 40 as well as foreign matter from entering into the tying tool body 4. Further, the guarding plates 74 prevent the wire W from wiggling left and right upon when the twisting mechanism 40 twists the wire W wound in the circular shape. The wire W guided by the lower curl guide 62 is fed toward the second guiding passage 66 of the upper curl guide 60.

The second guiding passage 66 of the upper curl guide 60 is provided with an upper-side guiding wall 76 that guides the wire W fed from the lower curl guide 62 and feeds the wire W from the forward end of the upper curl guide 60 toward the lower curl guide 62.

The lower curl guide 62 is attached to the front sides of the left outer housing 14 and the inner housing 16. The lower curl guide 62 is pivotaly supported by the left outer housing 14 and the inner housing 16 via a pivot shaft 62*a*. The lower curl guide 62 can pivot between an opened state shown in FIG. 6 and a closed state shown in FIG. 7. Notably, in FIGS. 6 and 7, the left outer housing 14 and the connection wires and the like inside the rebar tying tool 2 are not shown for easier view of the drawings. The lower curl guide 62 is biased in a closing direction by a torsion spring 62*b*. When the rebar tying tool 2 is used, the lower curl guide 62 is in the closed state. If the wire W is tangled onto the twisting mechanism 40 during the use of the rebar tying tool 2, the user can open the lower curl guide 62 and remove the tangled wire W on the twisting mechanism 40.

Figure 6:
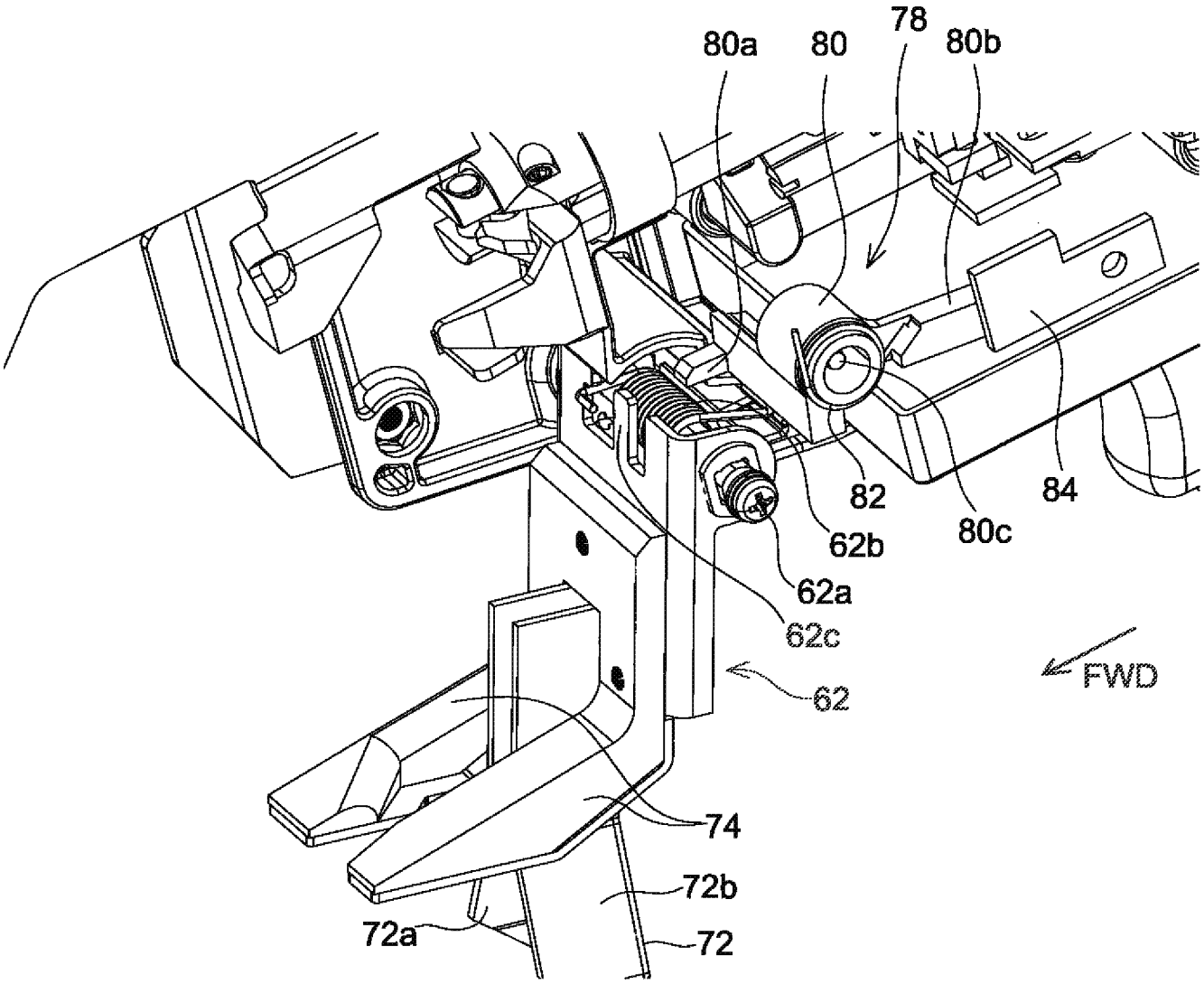
FIG. 6 is a perspective view showing a state in which a lower curl guide 62 of the rebar tying tool 2 of the embodiment is opened.
Figure 7:
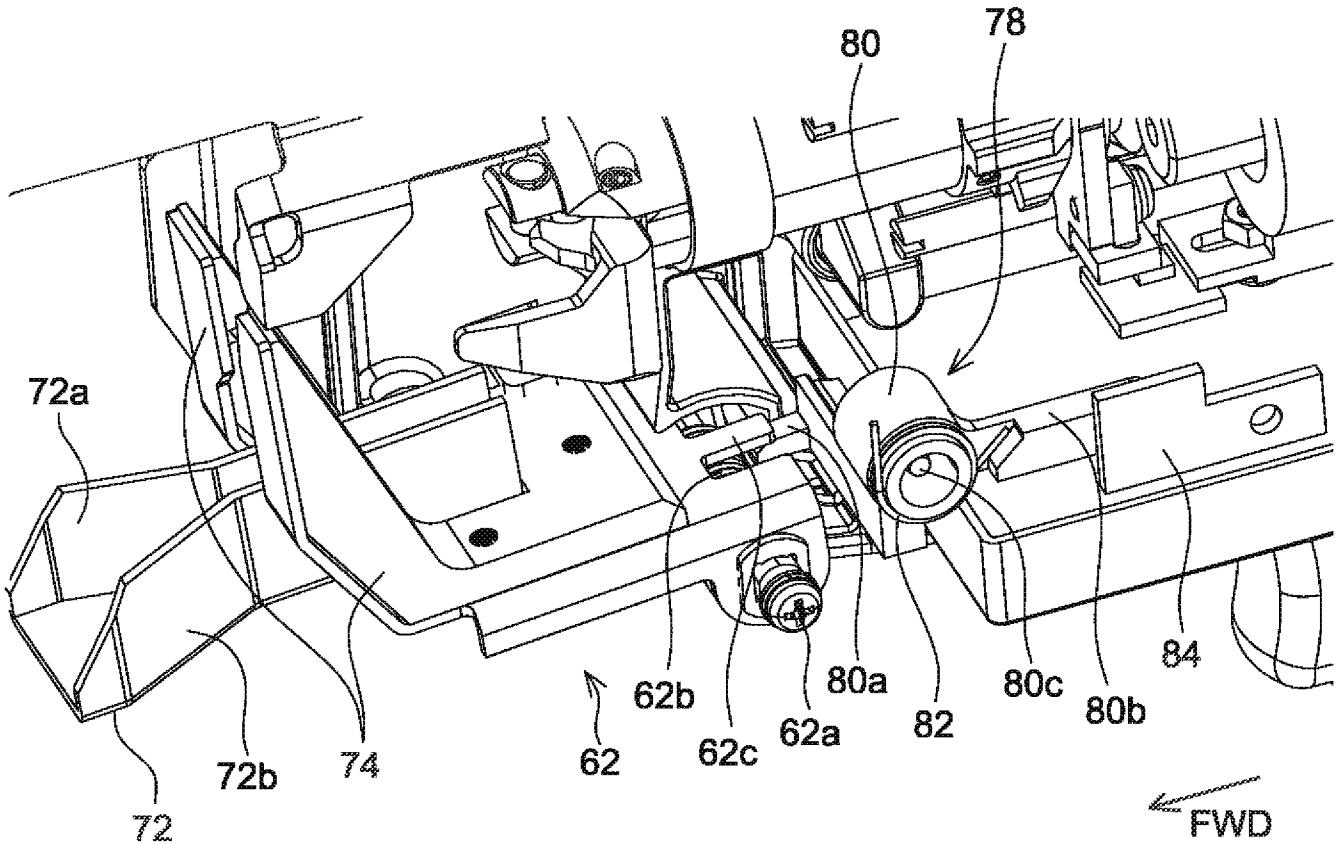
FIG. 7 is a perspective view showing a state in which the lower curl guide 62 of the rebar tying tool 2 of the embodiment is closed.
Figure 8:
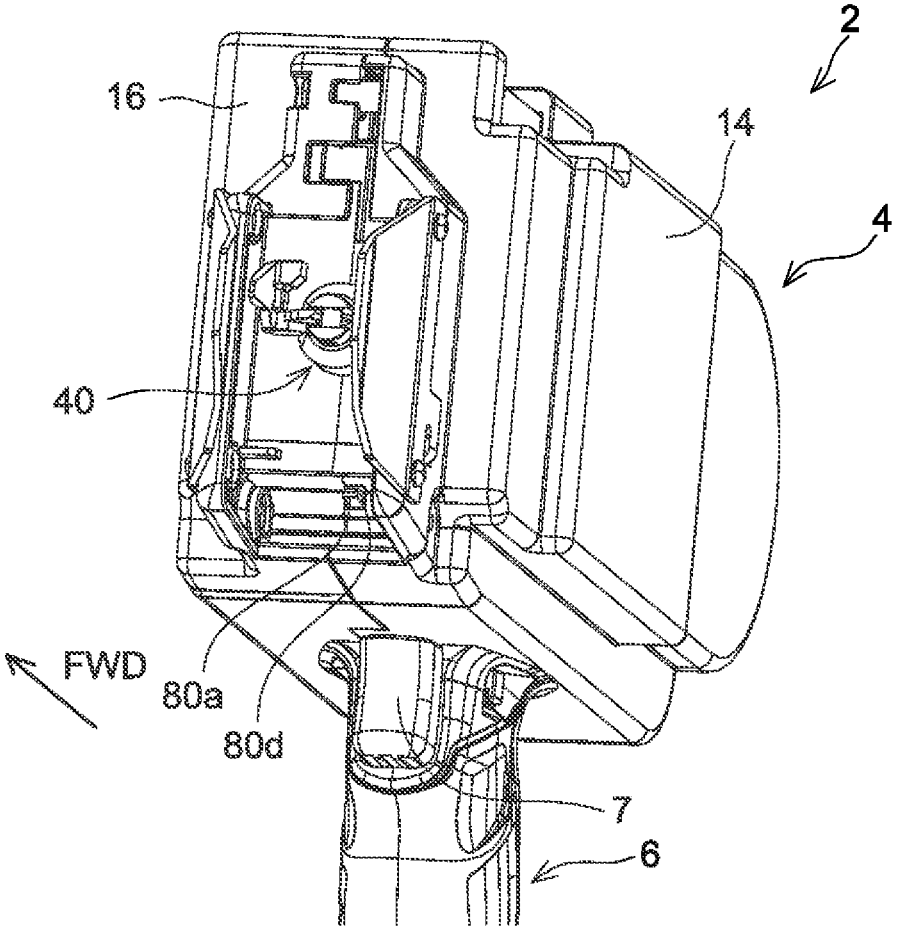
FIG. 8 is a view showing a contact piece 80*a* of a state detection mechanism 78 and a state detection opening 80*d* of a left outer housing 14 of the rebar tying tool 2 of the embodiment.

A state detection mechanism 78 configured to detect whether the lower curl guide 62 is in the opened state or the closed state is provided at a front lower portion inside the tying tool body 4. The state detection mechanism 78 is attached to the left outer housing 14. The state detection mechanism 78 comprises a state detection lever 80, a torsion spring 82, and a sensor board 84. The sensor board 84 is connected to the control board 180 by a connection wire (not shown). The state detection lever 80 comprises a contact piece 80*a* and a detection piece 80*b*. The state detection lever 80 is pivotaly supported by the left outer housing 14 via a pivot shaft 80*c*. As shown in FIG. 8, the contact piece 80*a* protrudes to an outside of the tying tool body 4 through a state detection opening 80*d* provided in the left outer housing 14. Notably, in FIG. 8, the upper curl guide 60 and the lower curl guide 62 are not shown for easier view of the drawing. The detection piece 80*b* shown in FIGS. 6 and 7 is provided with a permanent magnet (not shown). The sensor board 84 is fixed to the left outer housing 14. A magnetic sensor (not shown) such as a Hall element is provided on a surface of the sensor board 84 facing the detection piece 80*b*. As shown in FIG. 6, when the lower curl guide 62 is in the opened state, the state detection lever 80 pivots by biasing force of the torsion spring 82 and the permanent magnet of the detection piece 80*b* is positioned at a position away from the magnetic sensor of the sensor board 84. If the lower curl guide 62 is closed from the above state, a contact piece 62*c* provided at a rear portion of the lower curl guide 62 makes contact with the contact piece 80*a* of the state detection lever 80, and the state detection lever 80 pivots by the contact piece 80*a* of the state detection lever 80 being pressed down, as a result of which the permanent magnet of the detection piece 80*b* comes to be positioned at a position facing the magnetic sensor of the sensor board 84. A signal detected by the magnetic sensor of the sensor board 84 is inputted to the control board 180. The rebar tying tool 2 can determine whether the lower curl guide 62 is in the opened state or the closed state based on the detected signal of the magnetic sensor of the sensor board 84.

As shown in FIG. 8, a width of the state detection opening 80*d* in a left-and-right direction provided on the left outer housing 14 is substantially equal to a width of the contact piece 80*a* of the state detection lever 80 in the left-and-right direction. By configuring as such, the foreign matter can be prevented from entering into the tying tool body 4 through the state detection opening 80*d*. Further, a width of the state detection opening 80*d* in an up-and-down direction provided on the left outer housing 14 is substantially equal to a movable range of the contact piece 80*a*. By configuring as such, the foreign matter can be prevented from entering into the tying tool body 4 through the state detection opening 80*d*.

As shown in FIG. 1, the upper curl guide 60 feeds out the wire W from a forward upper side of the plural rebars R downward, and the lower curl guide 62 feeds out the wire W fed from the upper curl guide 60 from a rearward lower side of the plural rebars R upward. Due to this, the wire W fed from the feeding mechanism 32 is wound in the circular shape around the plural rebars R. When the feeding mechanism 32 feeds out a feed amount of the wire W set by the user, it stops the feeding motor 44 to terminate the feeding of the wire W.

Figure 9:
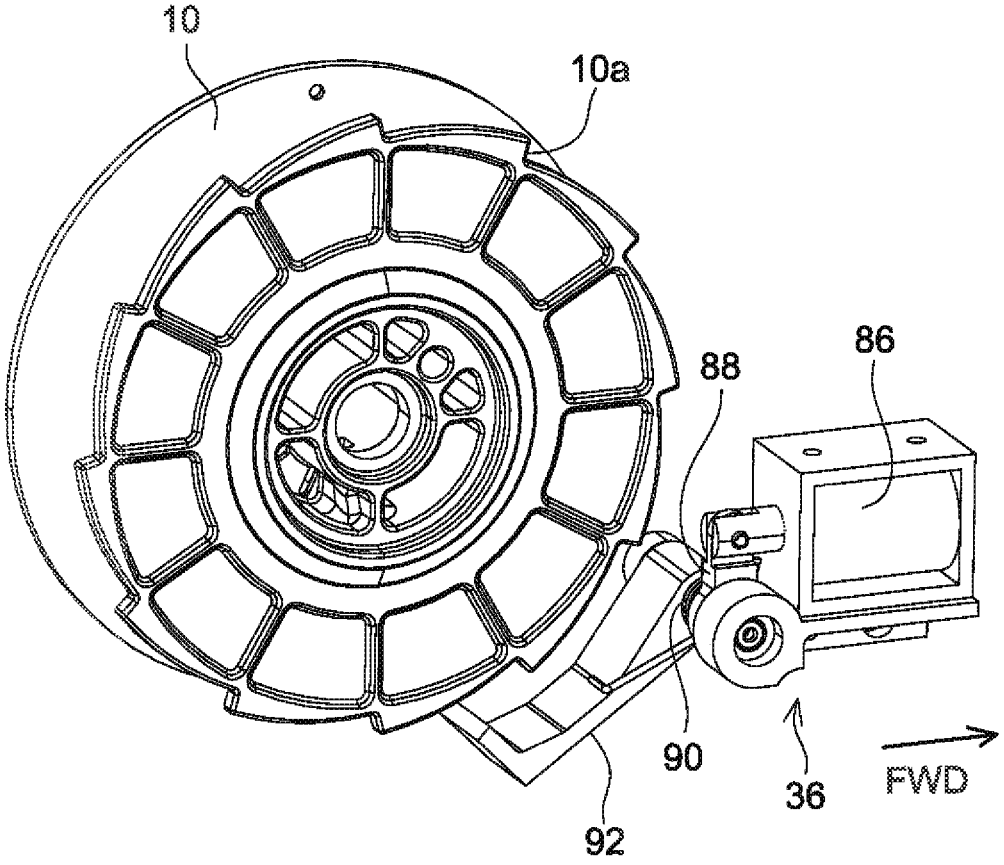
FIG. 9 is a perspective view showing an off state of a brake mechanism 36 of the rebar tying tool 2 of the embodiment.
Figure 10:
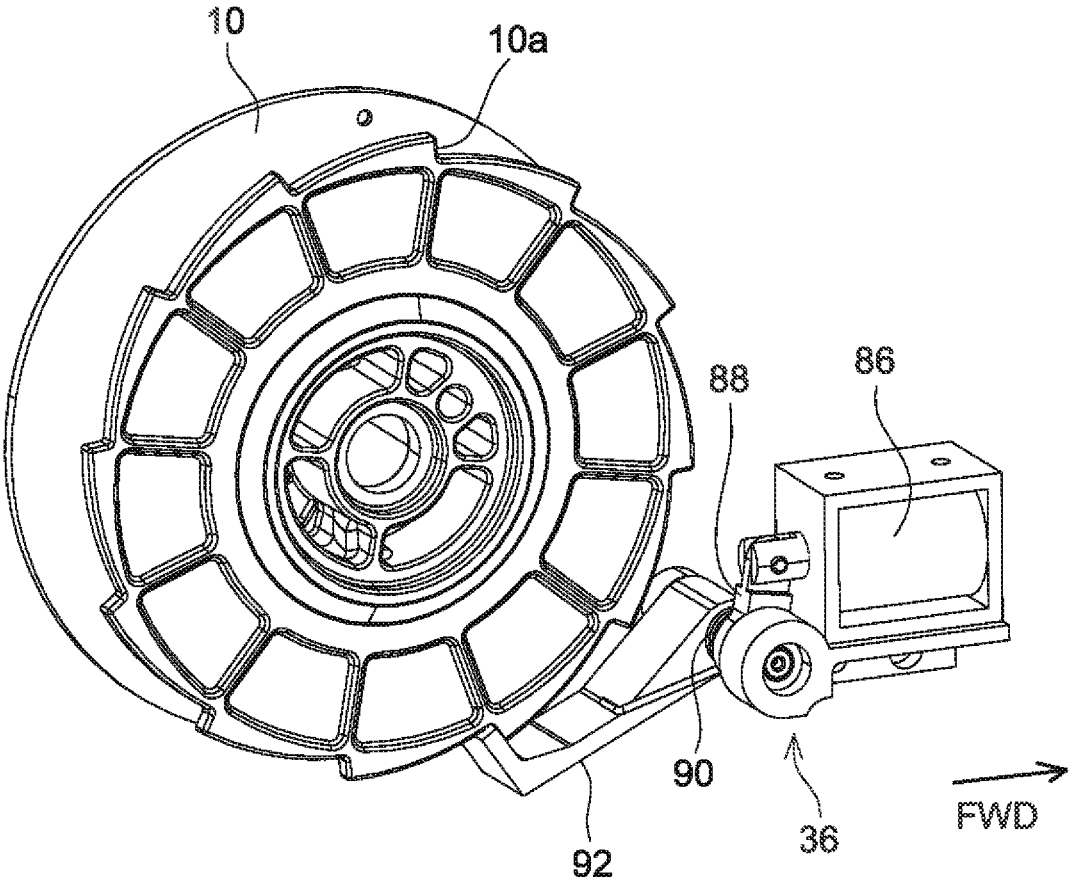
FIG. 10 is a perspective view showing an on state of the brake mechanism 36 of the rebar tying tool 2 of the embodiment.

The brake mechanism 36 shown in FIG. 2 stops rotation of the reel 10 in conjunction with the stop of the feeding of the wire W by the feeding mechanism 32. The brake mechanism 36 comprises a solenoid 86, a link 88 (see FIGS. 9 and 10), a torsion spring 90 (see FIGS. 9 and 10), and a brake arm 92. The solenoid 86 of the brake mechanism 36 is connected to the control board 180 by a connection wire (not shown). The control board 180 is configured to control an operation of the brake mechanism 36. The brake mechanism 36 is unitized, and is attached to the inner housing 16. The reel 10 is provided with engaging portions 10*a* with which the brake arm 92 engages, and provided at predetermined angle intervals in a circumferential direction of the reel 10. As shown in FIG. 9, in a state where the solenoid 86 is not energized, the brake arm 92 is separated away from the engaging portions 10*a* of the reel 10 by biasing force of the torsion spring 90. As shown in FIG. 10, in a state where the solenoid 86 is energized, the brake arm 92 pivots toward the reel 10 by the link 88, and the brake arm 92 engages with one of the engaging portions 10*a* of the reel 10. When the feeding of the wire W is performed by the feeding mechanism 32, the brake mechanism 36 does not energize the solenoid 86 to separate away the brake arm 92 from the engaging portions 10*a* of the reel 10. Due to this, the reel 10 can freely rotate, and the feeding mechanism 32 can draw out the wire W from the reel 10. Further, when the feeding of the wire W by the feeding mechanism 32 is stopped, the brake mechanism 36 energizes the solenoid 86 to engage the brake arm 92 with one of the engaging portions 10*a* of the reel 10. Due to this, rotation of the reel 10 is inhibited. According to the above, it can be prevented that the wire W becomes loose between the reel 10 and the feeding mechanism 32 by the reel 10 continuing to rotate by inertia even after the feeding mechanism 32 had stopped feeding out the wire W.

Figure 11:
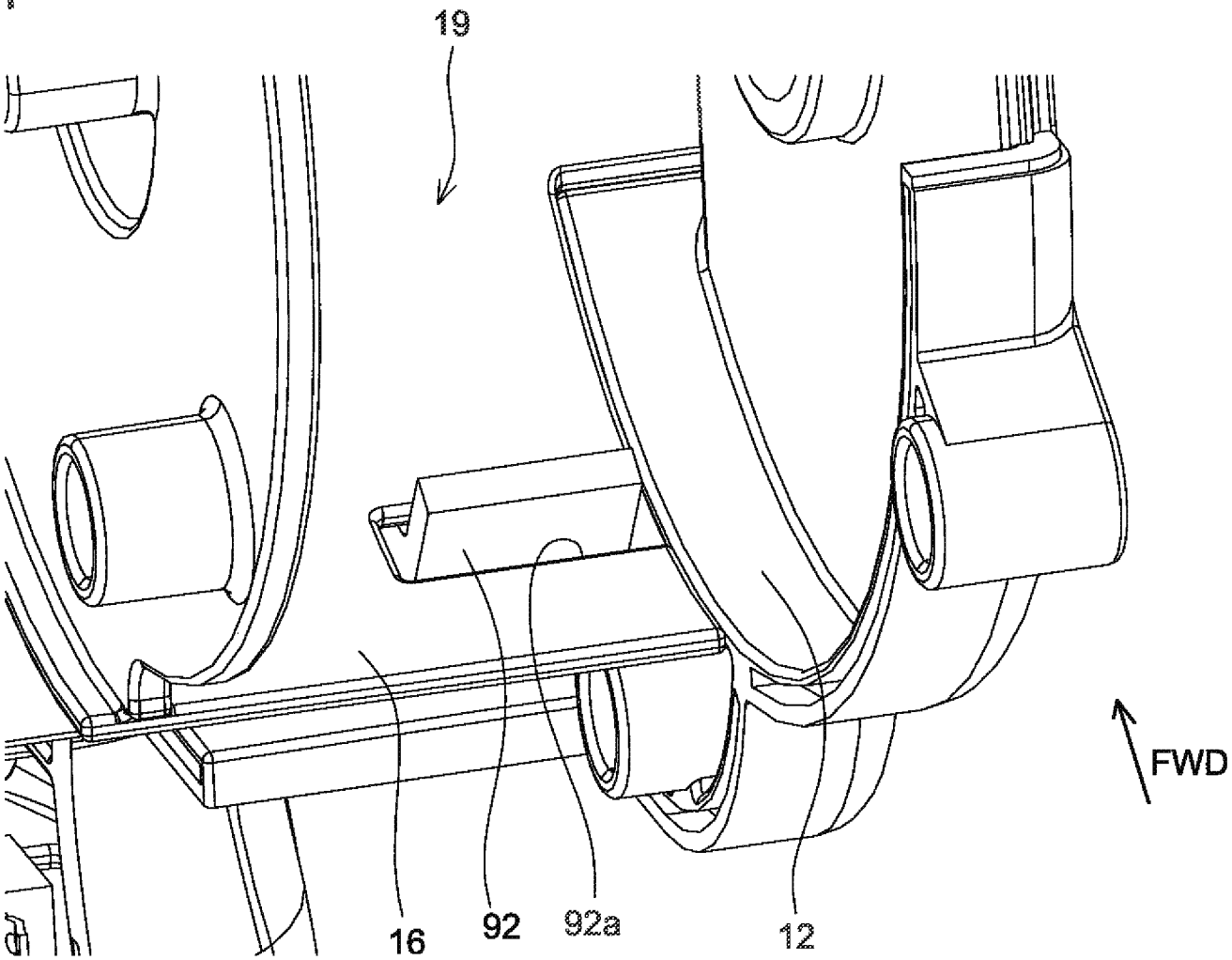
FIG. 11 is a view showing a brake arm 92 of the brake mechanism 36 and a brake opening 92*a* of an inner housing 16 of the rebar tying tool 2 of the embodiment.

As shown in FIG. 2, the brake mechanism 36 is housed in a brake chamber 37 which is inside the tying tool body 4 and defined by the right outer housing 12 and the inner housing 16. As shown in FIG. 11, the inner housing 16 is provided with a brake opening 92*a* through which a tip of the brake arm 92 passes. When the brake arm 92 is to be engaged with one of the engaging portions 10*a* of the reel 10, only the tip of the brake arm 92 passes through the brake opening 92*a* and engages with one of the engaging portions 10*a* of the reel 10 via the brake opening 92*a*. A width of the brake opening 92*a* in the left-and-right direction is substantially equal to a width of the tip of the brake arm 92. Further, a width of the brake opening 92*a* in the front-and-rear direction is substantially equal to a movable range of the tip of the brake arm 92. By configuring as such, the foreign matter can be prevented from entering into the tying tool body 4 through the brake opening 92*a*. Further, the brake chamber 37 communicates with an outside of the brake chamber 37 only via the brake opening 92*a*. By configuring as such, the foreign matter can be prevented from entering into the brake chamber 37. The brake mechanism 36 and other mechanisms existing around the brake mechanism 36 can be prevented from being affected by the foreign matter.

The cutting mechanism 38 shown in FIG. 4 cuts the wire W in a state where the wire W is wound around the rebars R. The cutting mechanism 38 comprises the cutter 70 and a link 94. The link 94 rotates the cutter 70 in cooperation with the twisting mechanism 40 to be described later. The wire W passing an inside of the cutter 70 is cut by the rotation of the cutter 70.

Figure 12:
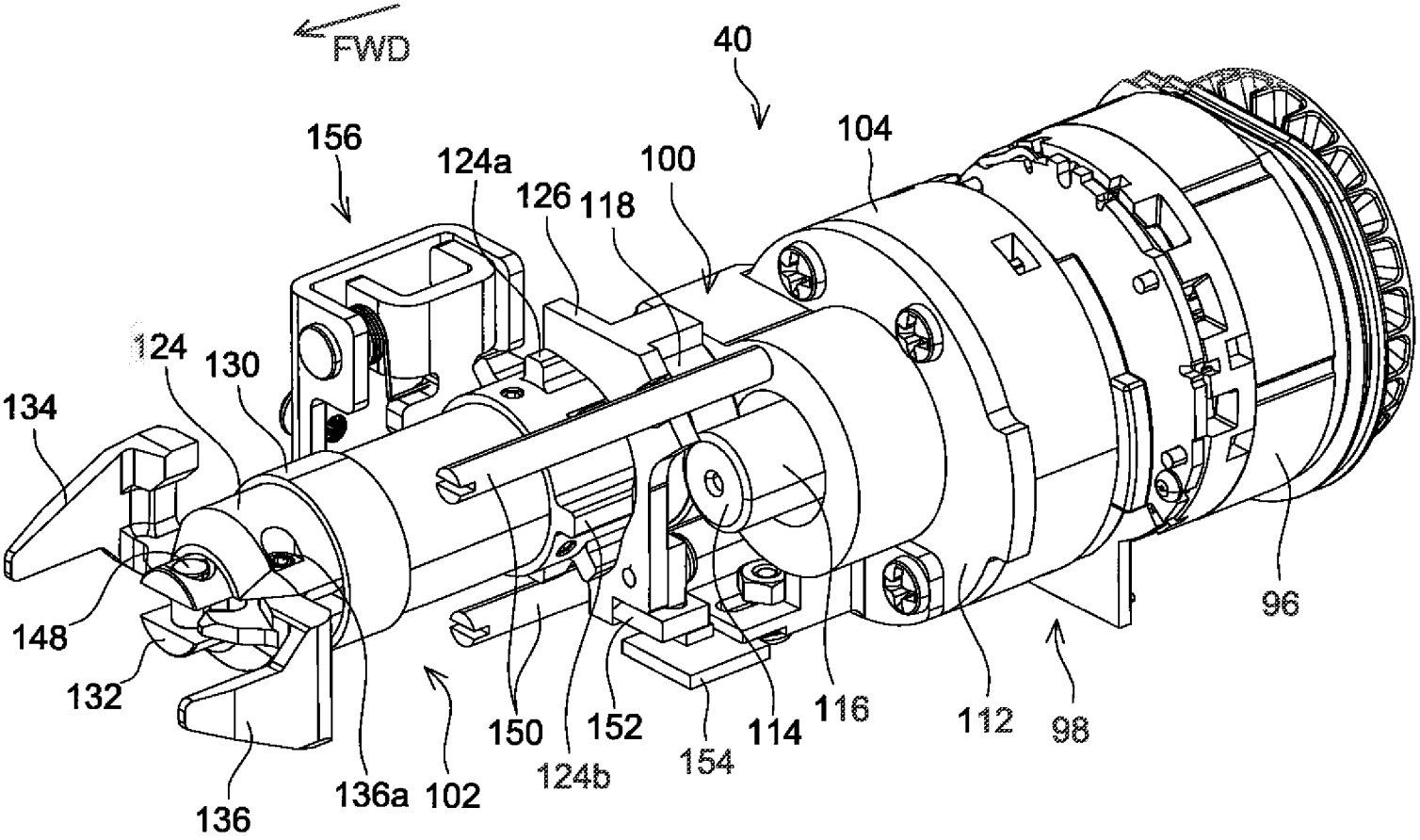
FIG. 12 is a perspective view showing a twisting mechanism 40 of the rebar tying tool 2 of the embodiment.

The twisting mechanism 40 shown in FIG. 5 ties the plural rebars R with the wire W by twisting the wire W wound around the plural rebars R. As shown in FIG. 12, the twisting mechanism 40 comprises a twisting motor 96, a first reduction mechanism 98, a second reduction mechanism 100, and a grip mechanism 102. The twisting motor 96 is connected to the control board 180 by a connection wire (not shown). The control board 180 is configured to control an operation of the twisting motor 96. The twisting mechanism 40 is unitized, and is attached to the left outer housing 14.

Figure 13:
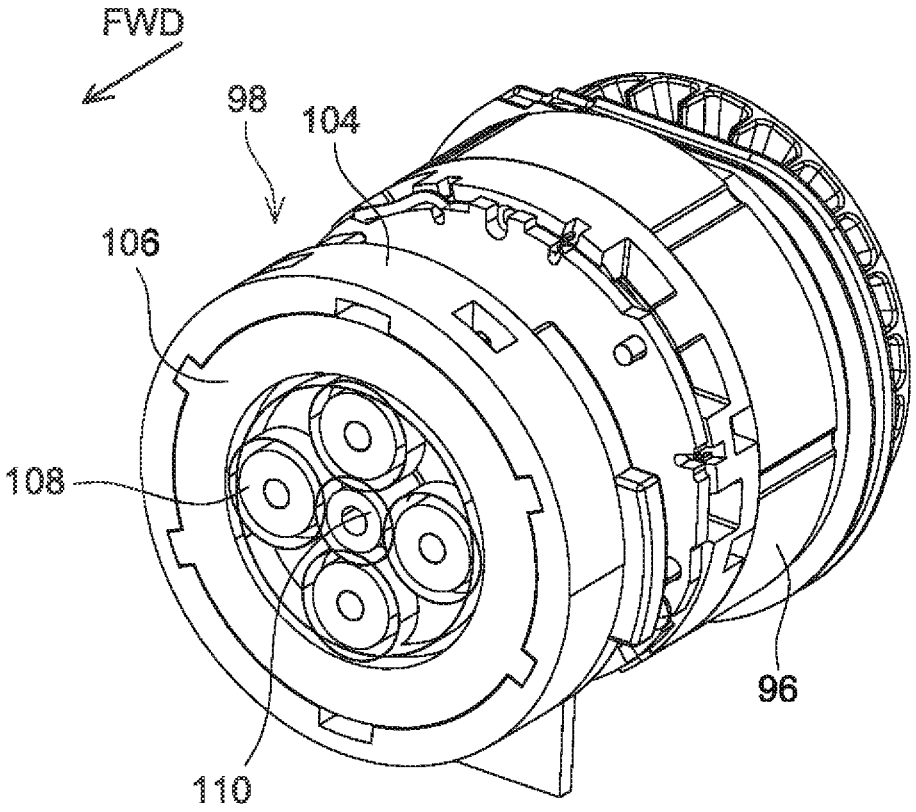
FIG. 13 is a cross sectional perspective view showing an internal structure of a first reduction mechanism 98 of the rebar tying tool 2 of the embodiment.

As shown in FIG. 13, the first reduction mechanism 98 is a planetary gear reduction mechanism. The first reduction mechanism 98 comprises a gear bracket 104, an internal gear 106, planetary gears 108, and a sun gear 110. The gear bracket 104 is fixed to a main bracket 112 (see FIG. 12). The internal gear 106 is fixed to the gear bracket 104. The sun gear 110 is coupled to an output shaft of the twisting motor 96. The planetary gears 108 are coupled to a relay shaft 114 (see FIG. 14) via a planetary carrier (not shown). The first reduction mechanism 98 reduces rotation of the twisting motor 96 and transmits the same to the relay shaft 114.

Figure 14:
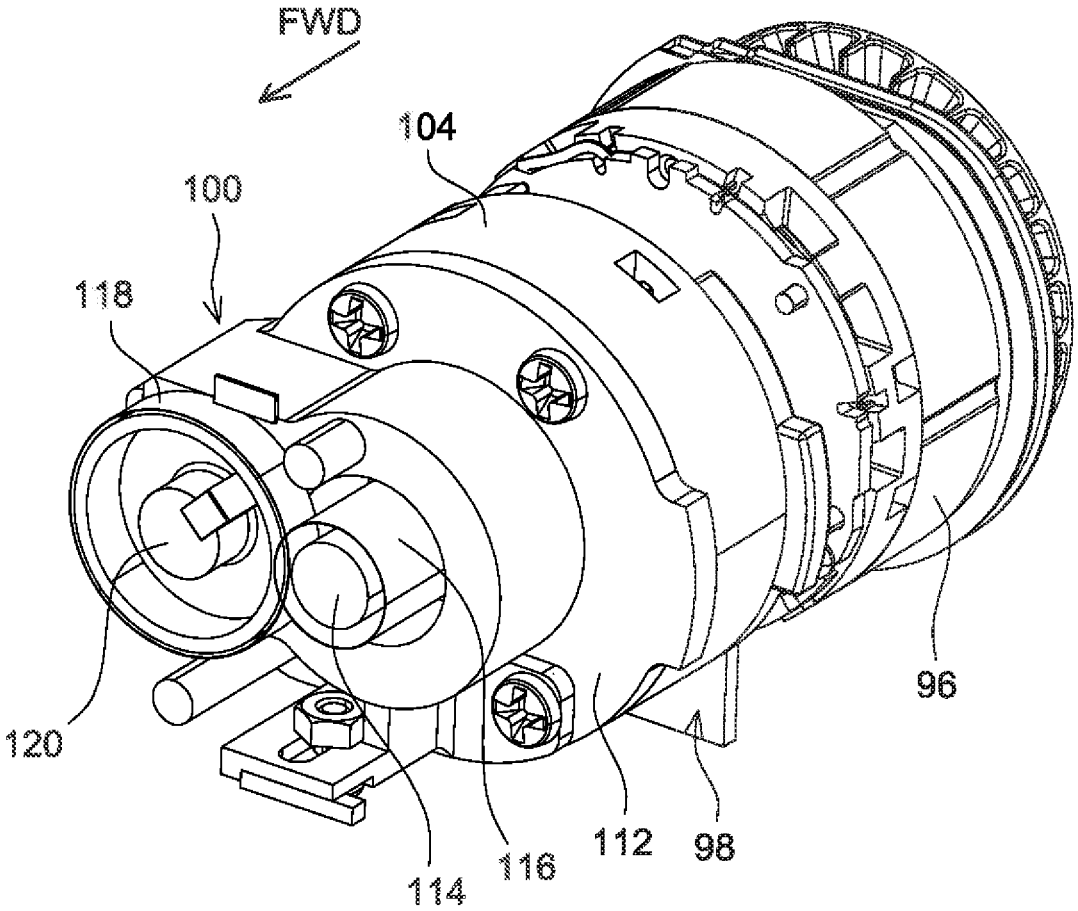
FIG. 14 is a cross sectional perspective view showing an internal structure of a second reduction mechanism 100 of the rebar tying tool 2 of the embodiment.

As shown in FIG. 14, the second reduction mechanism 100 is a spur gear reduction mechanism. The second reduction mechanism 100 comprises a first spur gear 116 and a second spur gear 118. The first spur gear 116 is coupled to the relay shaft 114. The second spur gear 118 is coupled to a screw shaft 120. The second reduction mechanism 100 reduces rotation of the relay shaft 114 and transmits the same to the screw shaft 120.

Figure 15:
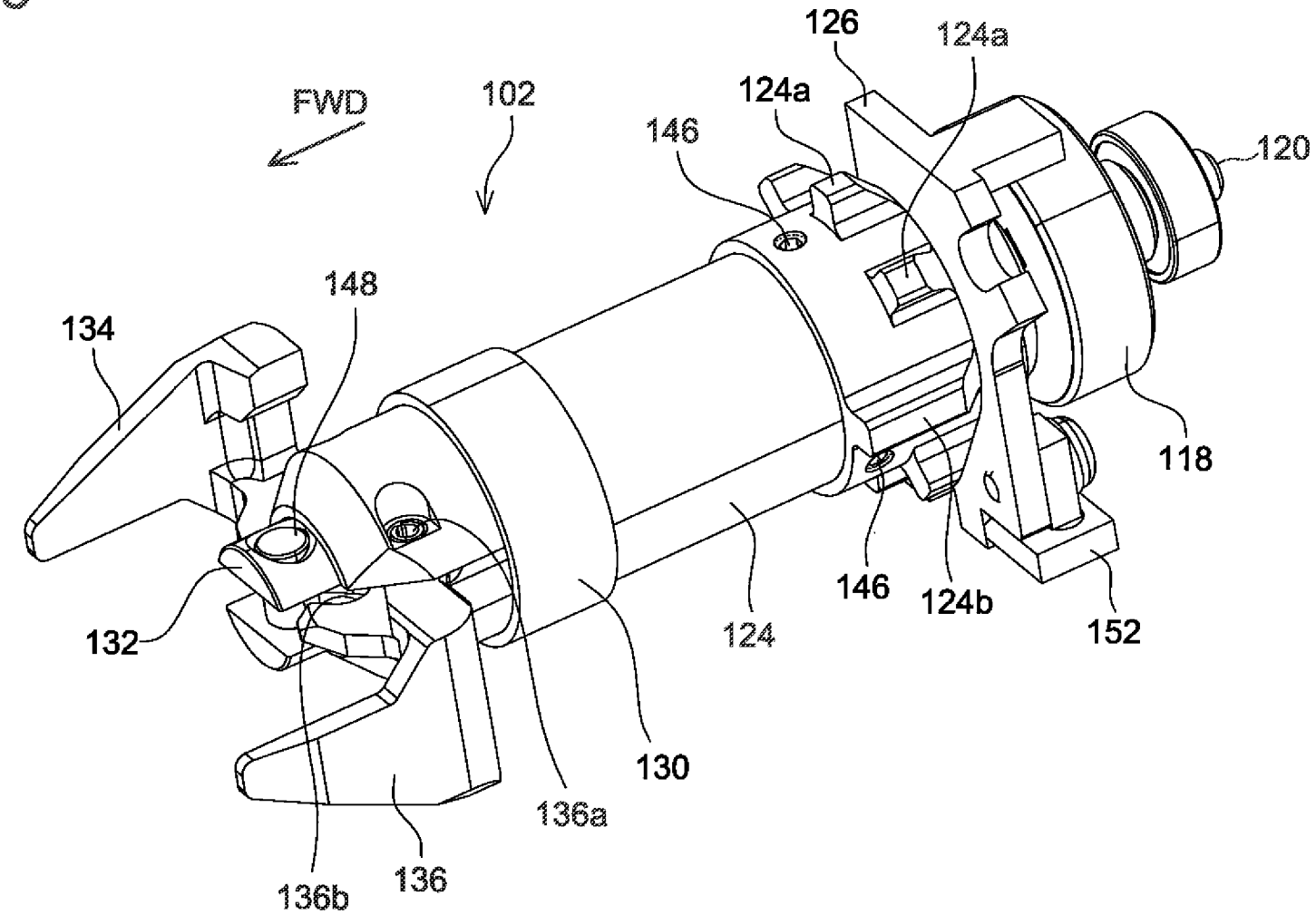
FIG. 15 is a perspective view showing a grip mechanism 102 of the rebar tying tool 2 of the embodiment.
Figure 16:
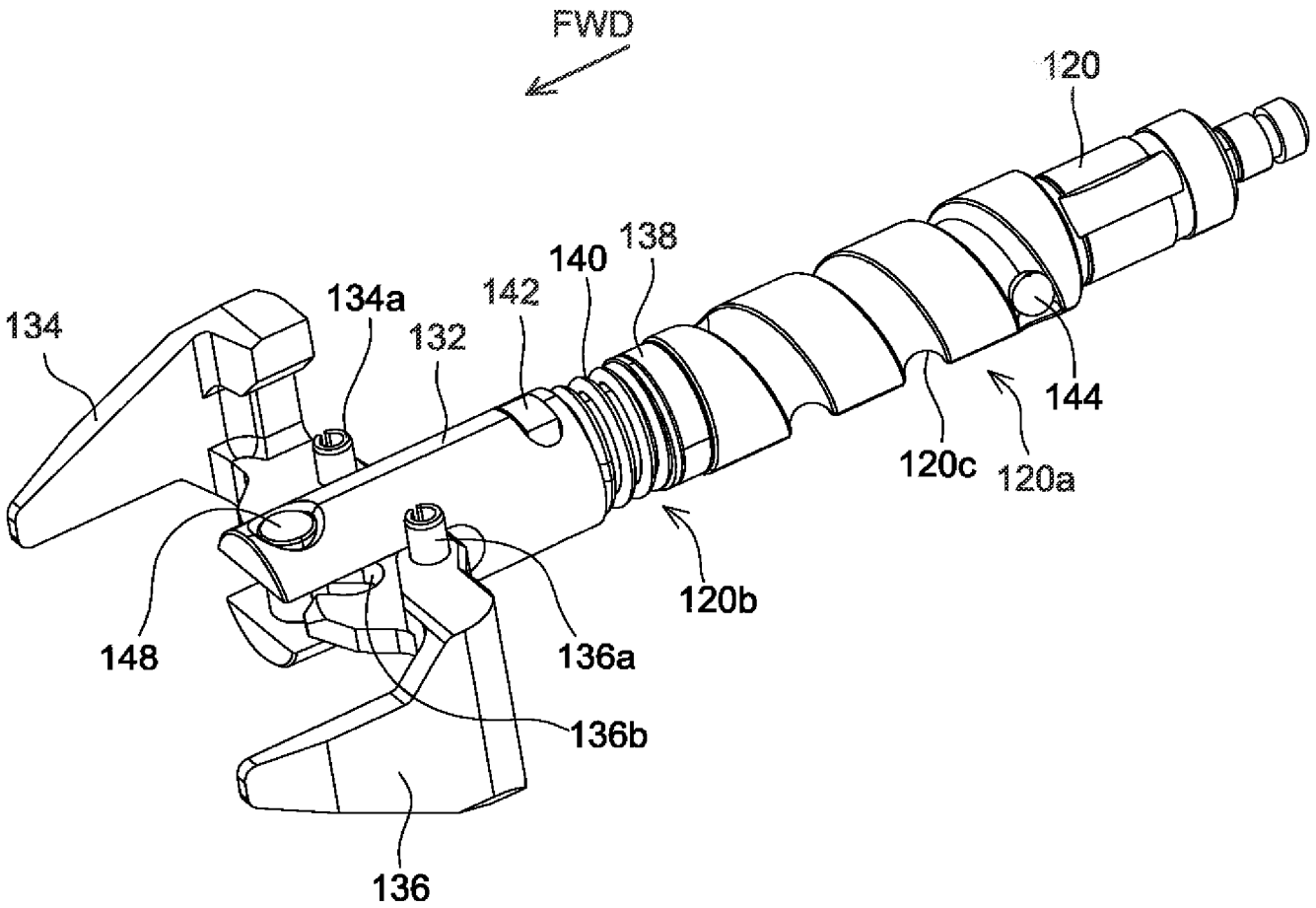
FIG. 16 is a perspective view showing a screw shaft 120, a distal shaft 132, a right hook 134, and a left hook 136 of the rebar tying tool 2 of the embodiment.
Figure 17:
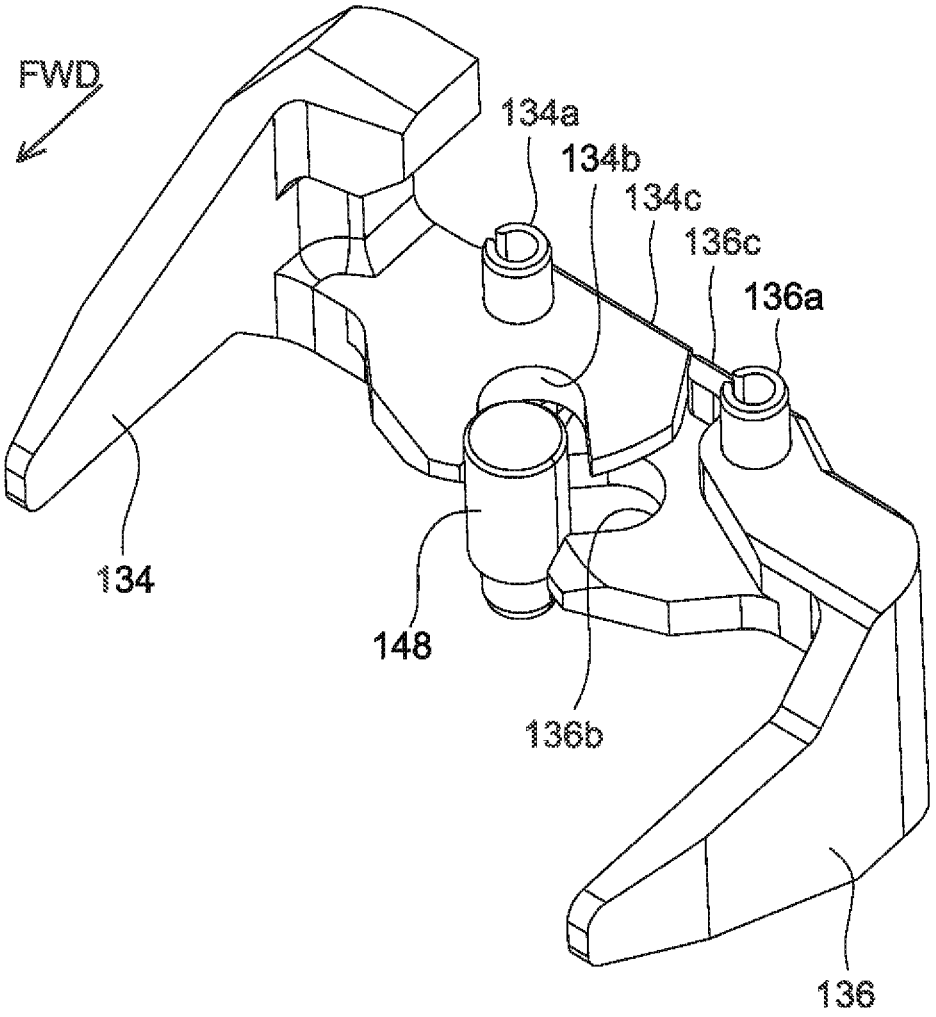
FIG. 17 is a perspective view showing the right hook 134 and the left hook 136 of the rebar tying tool 2 of the embodiment.

As shown in FIGS. 15 to 17, the grip mechanism 102 comprises the screw shaft 120, an inner sleeve 122 (see FIGS. 19 to 22), an outer sleeve 124, a push plate 126, a push sleeve 128 (see FIGS. 19 to 22), a supporting sleeve 130, a distal shaft 132, a right hook 134, and a left hook 136.

As shown in FIG. 16, the screw shaft 120 has its rear side configured as a large diameter portion 120*a*, and its front side configured as a small diameter portion 120*b*. A spiral ball groove 120*c* is provided on an outer surface of the large diameter portion 120*a*. A bumper 138 constituted of a circular elastic material is provided at a portion with a diameter difference between the large diameter portion 120*a* and the small diameter portion 120*b*. A compression spring 140 is provided around the small diameter portion 120*b*. The compression spring 140 biases the distal shaft 132 in a direction separating away from the bumper 138. Further, an engaging groove 120*d* (see FIGS. 19 to 22) with which a stopper 142 of the distal shaft 132 engages is provided at a tip end of the small diameter portion 120*b*.

The inner sleeve 122 shown in FIGS. 19 to 22 is a cylindrical member into which the screw shaft 120 is to be inserted. The inner sleeve 122 is provided with a ball hole (not shown) in which a ball 144 shown in FIG. 16 is to fit. The screw shaft 120 and the inner sleeve 122 are coupled via the ball 144 fitted between the ball groove 120*c* and the ball hole. That is, the screw shaft 120 and the inner sleeve 122 are coupled via a ball screw. In a range where the ball groove 120*c* is provided, the inner sleeve 122 moves in the front-and-rear direction relative to the screw shaft 120 when the screw shaft 120 relatively rotates with respect to the inner sleeve 122.

As shown in FIG. 15, the outer sleeve 124 is a cylindrical member into which the inner sleeve 122 and the distal shaft 132 are to be inserted. The outer sleeve 124 is fixed to the inner sleeve 122 by a fixation screw 146.

The right hook 134 and the left hook 136 constitute a gripping member for gripping the wire W. As shown in FIG. 15, the left hook 136 is pivotaly supported on the outer sleeve 124 via a pivot shaft 136*a*. As shown in FIG. 16, the left hook 136 is provided with a cam groove 136*b*. Similarly, the right hook 134 is pivotaly supported on the outer sleeve 124 via a pivot shaft 134*a*. The right hook 134 is provided with a cam groove 134*b* (see FIG. 17). As shown in FIG. 15, the distal shaft 132 is slidably inserted in the outer sleeve 124. The distal shaft 132 is provided with a cam pin 148 that engages with the cam groove 134*b* of the right hook 134 and the cam groove 136*b* of the left hook 136. As shown in FIG. 17, when the distal shaft 132 relatively moves forward with respect to the outer sleeve 124, the right hook 134 and the left hook 136 pivot in a direction which allows the cam pin 148 to come out from the cam grooves 134*b* and 136*b*, resulting in the right hook 134 and the left hook 136 being in an opened state. Notably, in a state where the right hook 134 and the left hook 136 are opened to their maximum degree, a stopper portion 134*c* provided in the right hook 134 and a stopper portion 136*c* provided in the left hook 136 make contact with each other, and the right hook 134 and the left hook 136 cannot be opened any further. As a result, the distal shaft 132 is inhibited from moving forward any further relative to the outer sleeve 124. When the distal shaft 132 relatively moves backward with respect to the outer sleeve 124, the right hook 134 and the left hook 136 pivot so that the cam pin 148 enters into the cam grooves 134*b* and 136*b*, resulting in the right hook 134 and the left hook 136 being in a closed state. As shown in FIGS. 19 to 22, the distal shaft 132 is provided with the stopper 142 that engages with the engaging groove 120*d* of the screw shaft 120. The distal shaft 132 is allowed to move relatively in the front-and-rear direction with respect to the screw shaft 120 within a range defined by the stopper 142 engaging with a front end and a rear end of the engaging groove 120*d*.

As shown in FIGS. 19 to 22, the push sleeve 128 is a cylindrical member covering a periphery of the inner sleeve 122. The push sleeve 128 is held between a rib 122*a* provided at a rear end of the inner sleeve 122 and the outer sleeve 124. The push sleeve 128 is rotatable relative to the inner sleeve 122. The push plate 126 is held between a rib 128*a* provided on the push sleeve 128 and the outer sleeve 124. As shown in FIG. 12, the push plate 126 is inhibited from rotating by pins 150 extending from the main bracket 112, and is guided thereby in the front-and-rear direction. The push plate 126 moves in the front-and-rear direction with the outer sleeve 124. When the push plate 126 moves forward, the link 94 of the cutting mechanism 38 of FIG. 4 is driven, and the cutter 70 cuts the wire W. Thereafter, when the push plate 126 moves backward, the link 94 of the cutting mechanism 38 is driven in an opposite direction, and the cutter 70 is brought to its initial posture. Further, as shown in FIG. 12, the push plate 126 is provided with a permanent magnet 152. The main bracket 112 is provided with a magnetic sensor 154 corresponding to the permanent magnet 152. The magnetic sensor 154 is connected to the control board 180 by a connection wire (not shown). A signal detected by the magnetic sensor 154 is inputted to the control board 180. The rebar tying tool 2 can determine whether or not the push plate 126 is in its initial position based on the detection result of the magnetic sensor 154.

As shown in FIG. 15, the supporting sleeve 130 is a cylindrical member covering a periphery of the outer sleeve 124. The supporting sleeve 130 is rotatable relative to the outer sleeve 124, and is movable in the front-and-rear direction. The supporting sleeve 130 is supported by the left outer housing 14 and the inner housing 16 rotatably but immovably in the front-and-rear direction.

On an outer surface of the outer sleeve 124 on its rear side, short fins 124*a* and long fins 124*b* extending in the front-and-rear direction are provided. The short fins 124*a* and the long fins 124*b* allow or inhibit rotation of the outer sleeve 124 in cooperation with a rotation restricting mechanism 156 (see FIG. 12). In the rebar tying tool 2 of the present embodiment, on the outer surface of the outer sleeve 124, two long fins 124*b* are disposed at 180 degrees' intervals, and six short fins 124*a* are disposed at 45 degrees' intervals between those two long fins 124*b*.

Figure 18:
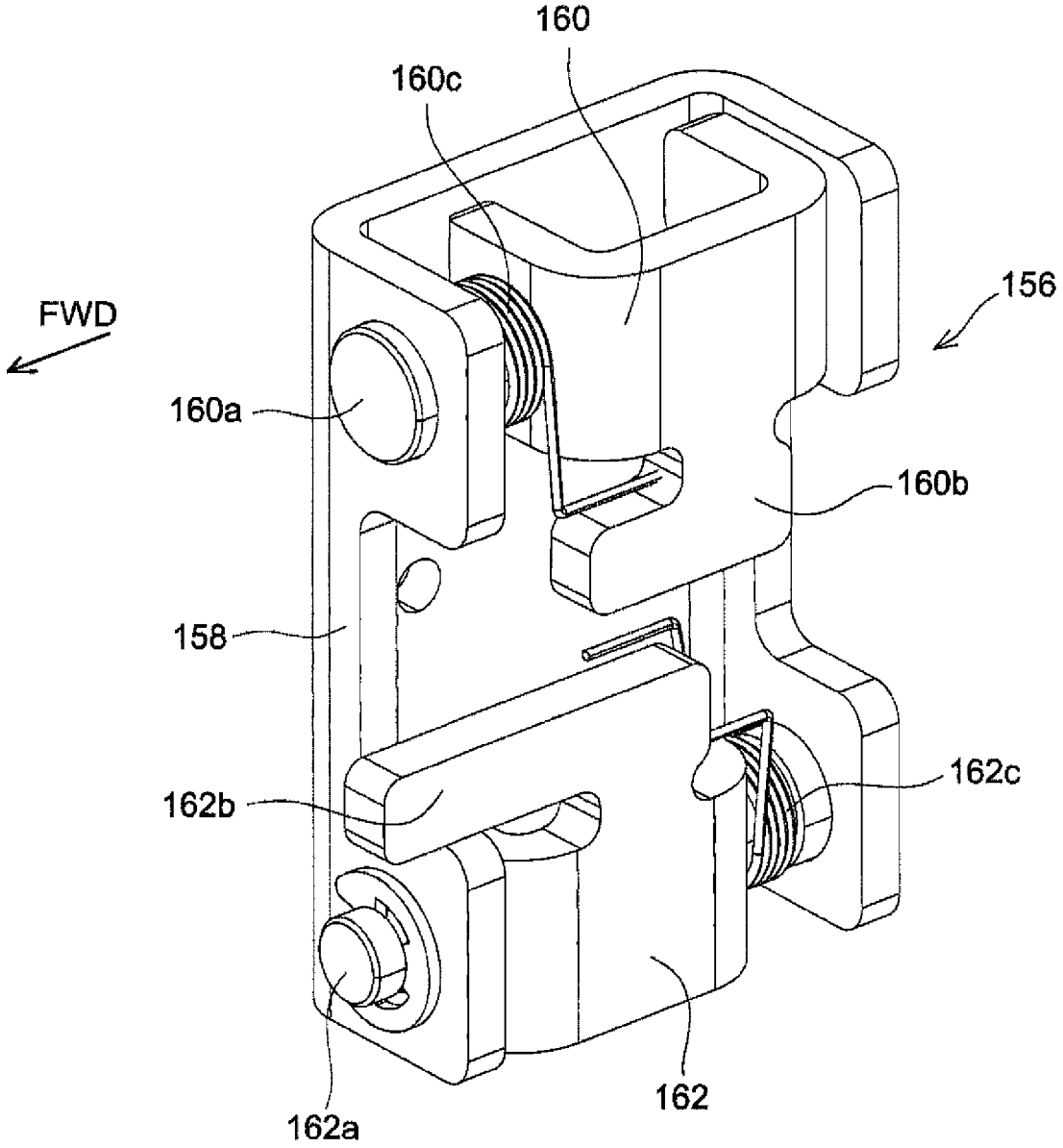
FIG. 18 is a perspective view showing a rotation restricting mechanism 156 of the rebar tying tool 2 of the embodiment.

As shown in FIG. 18, the rotation restricting mechanism 156 comprises a base member 158, an upper arm member 160, and a lower arm member 162. The base member 158 is fixed to the inner housing 16. The upper arm member 160 is pivotaly supported by the base member 158 via a pivot shaft 160*a*. The upper arm member 160 comprises a restriction piece 160*b*. The upper arm member 160 is biased by a torsion spring 160*c* in a direction along which the restriction piece 160*b* is opened outward. In a case where the screw shaft 120 rotates in a clockwise direction (the twisting mechanism 40 has finished twisting the wire W and returns to its initial posture), the short fins 124*a* and the long fins 124*b* serve topress in the upper arm member 160, and thus the upper arm member 160 does not inhibit the rotation of the outer sleeve 124. In a case where the outer sleeve 124 rotates in a counterclockwise direction (the twisting mechanism 40 is griping the wire W and twists it), the short fins 124*a* and the long fins 124*b* come into contact with an end surface of the restriction piece 160*b*, and thus the upper arm member 160 inhibits the rotation of the outer sleeve 124. The lower arm member 162 is pivotaly supported by the base member 158 via a pivot shaft 162*a*. The lower arm member 162 comprises a restriction piece 162*b*. The lower arm member 162 is biased by a torsion spring 162*c* in a direction along which the restriction piece 162*b* is opened outward. In the case where the outer sleeve 124 rotates in the counterclockwise direction (the twisting mechanism 40 is gripping the wire W and twists it), the short fins 124*a* and the long fins 124*b* serve to press in the lower arm member 162, and thus the lower arm member 162 does not inhibit the rotation of the outer sleeve 124. In the case where the outer sleeve 124 rotates in the clockwise direction (the twisting mechanism 40 has finished twisting the wire W and returns to its initial posture), the short fins 124*a* and the long fins 124*b* come into contact with an end surface of the restriction piece 162*b*, and thus the lower arm member 162 inhibits the rotation of the outer sleeve 124. As shown in FIG. 18, a rear end of the restriction piece 160*b* of the upper arm member 160 is disposed more rearward than a rear end of the restriction piece 162*b* of the lower arm member 162. Further, a front end of the restriction piece 162*b* of the lower arm member 162 is disposed more forward than a front end of the restriction piece 160*b* of the upper arm member 160.

Figure 19:
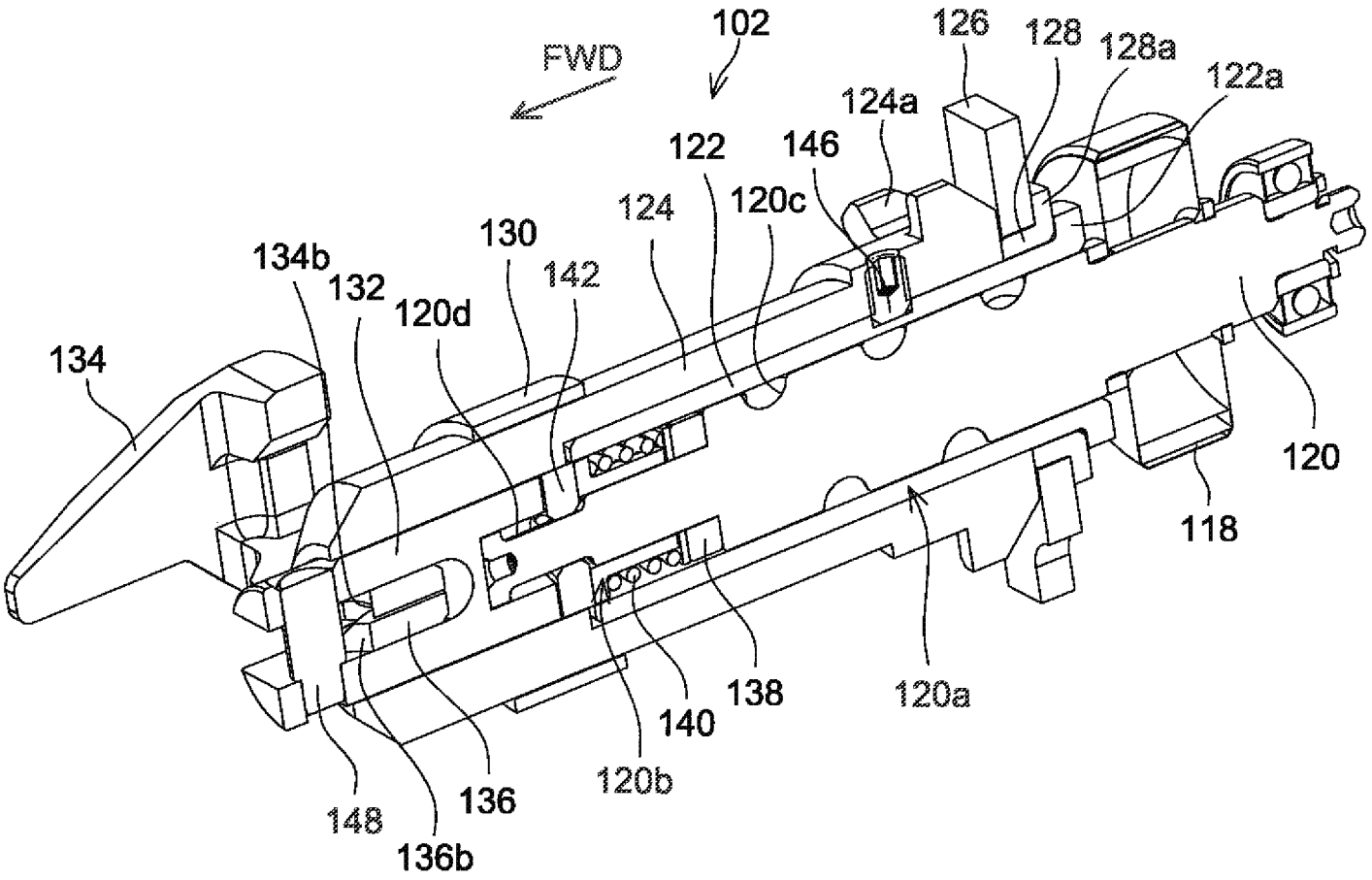
FIG. 19 is a cross sectional perspective view showing an operation of the grip mechanism 102 of the rebar tying tool 2 of the embodiment.

FIGS. 19 to 22 show an operation of the grip mechanism 102. As shown in FIG. 19, with an initial posture before the twisting motor 96 is driven, most part of the screw shaft 120 is housed within the inner sleeve 122, and one of the long fins 124*b* of the outer sleeve 124 is held between the upper arm member 160 and the lower arm member 162 of the rotation restricting mechanism 156. Further, the distal shaft 132 is in a state of having moved forward relative to the outer sleeve 124, and the right hook 134 and the left hook 136 are in their maximum opened state.

Figure 20:
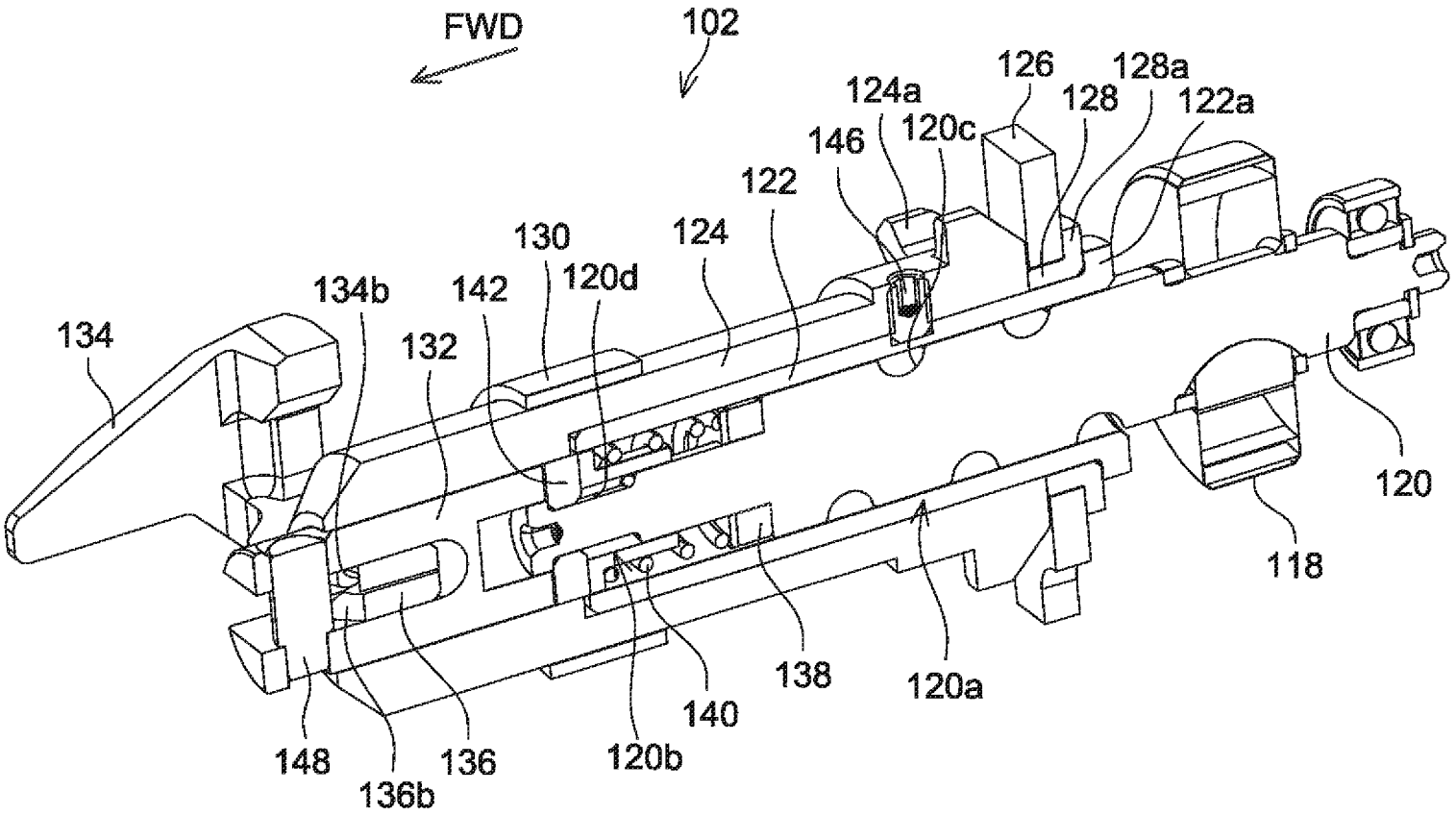
FIG. 20 is a cross sectional perspective view showing the operation of the grip mechanism 102 of the rebar tying tool 2 of the embodiment.

From this state, when the screw shaft 120 rotates in the counterclockwise direction by being driven by the twisting motor 96, since the rotation of the outer sleeve 124 is inhibited due to the long fin 124*b* being in contact with the restriction piece 160*b* of the upper arm member 160, the inner sleeve 122 and the outer sleeve 124 move forward relative to the screw shaft 120 as shown in FIG. 20. As the outer sleeve 124 moves forward, the distal shaft 132 also moves forward relative to the screw shaft 120 due to the biasing force of the compression spring 140. The distal shaft 132 can move forward until the stopper 142 comes into contact with the front end of the engaging groove 120*d*.

Figure 21:
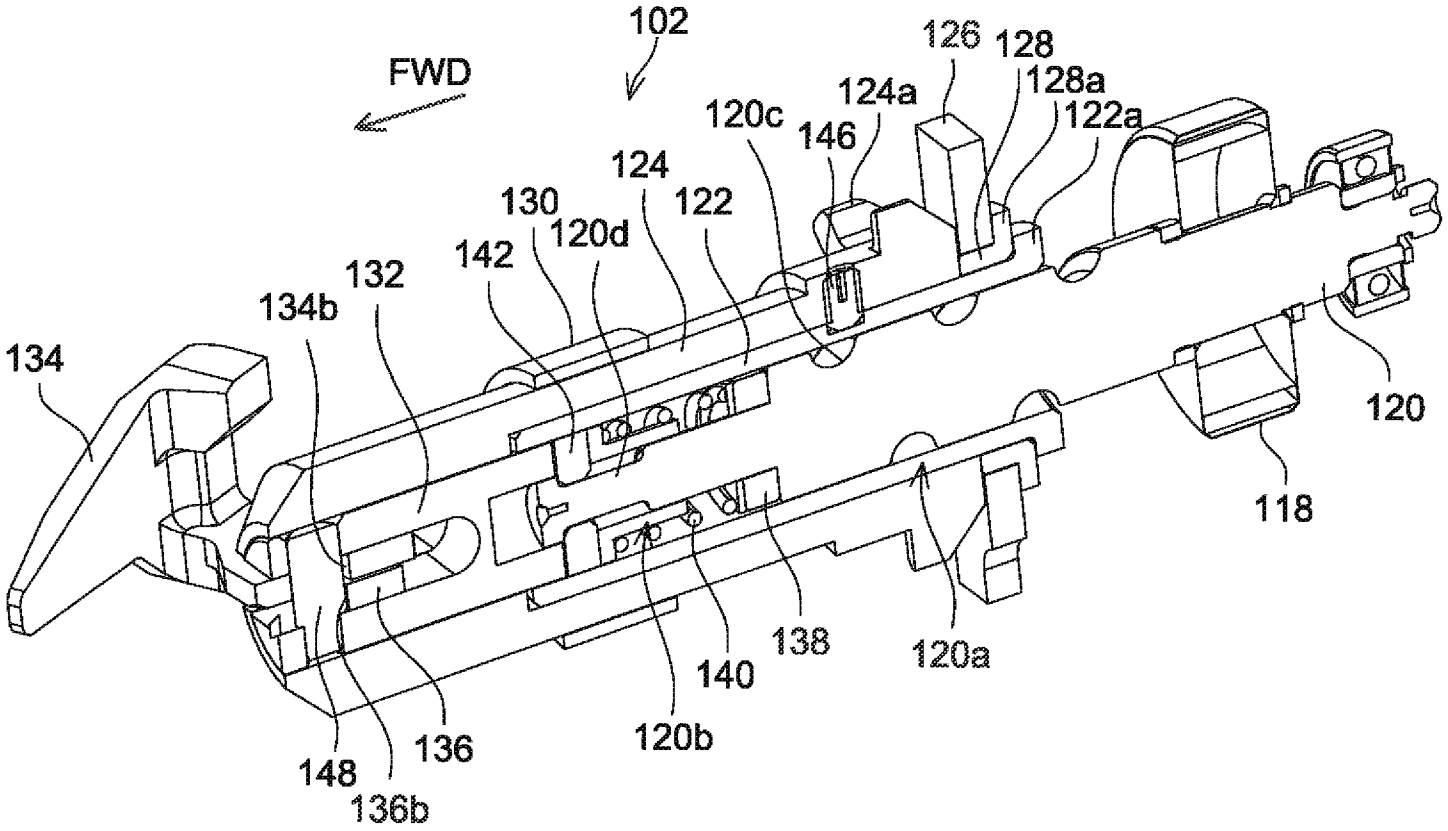
FIG. 21 is a cross sectional perspective view showing the operation of the grip mechanism 102 of the rebar tying tool 2 of the embodiment.

From this state, when the screw shaft 120 rotates further in the counterclockwise direction, the outer sleeve 124 further moves forward relative to the screw shaft 120 as shown in FIG. 21. However, the distal shaft 132 cannot move forward any further because the stopper 142 is in contact with the front end of the engaging groove 120*d*. Due to this, the distal shaft 132 is relatively drawn into the outer sleeve 124, and the right hook 134 and the left hook 136 move in a closing direction.

Figure 22:
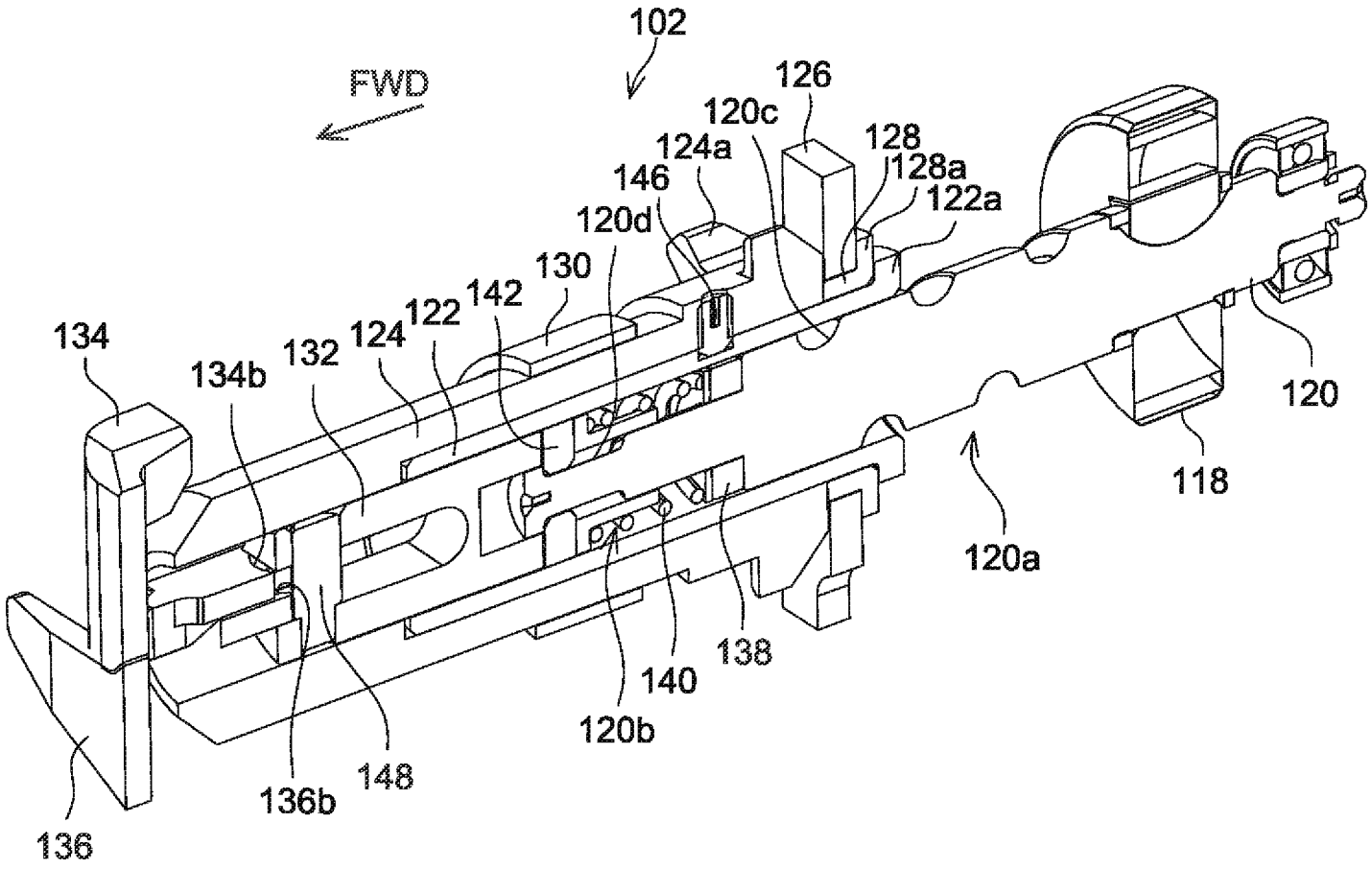
FIG. 22 is a cross sectional perspective view showing the operation of the grip mechanism 102 of the rebar tying tool 2 of the embodiment.

From this state, when the screw shaft 120 rotates yet further in the counterclockwise direction, the outer sleeve 124 further moves forward relative to the screw shaft 120. As shown in FIG. 22, the distal shaft 132 is completely drawn into the outer sleeve 124, and the right hook 134 and the left hook 136 come to be in a completely closed state. Due to this, the wire W is gripped by the right hook 134 and the left hook 136.

At a timing shortly before the right hook 134 and the left hook 136 are completely closed, the long fin 124*b* and the upper arm member 160 comes to be no longer in contact in the rotation restricting mechanism 156. Due to this, after this timing, the outer sleeve 124 rotates accompanying the rotation of the screw shaft 120, and the right hook 134 and the left hook 136 also rotate. Due to this, the wire W gripped by the right hook 134 and the left hook 136 is twisted. The twisting mechanism 40 rotates the twisting motor 96 in a reverse direction after having twisted the wire W to a certain twisting strength.

When the twisting motor 96 is rotated in the reverse direction, that is, in the clockwise direction, the screw shaft 120 also rotates in the clockwise direction. At this occasion, when the outer sleeve 124 rotates slightly, one of the the short fins 124*a* or one of the long fins 124*b* makes contact with the restriction piece 162*b* of the lower arm member 162, and the rotation of the outer sleeve 124 is thereby inhibited; thus, the outer sleeve 124 moves backward relative to the screw shaft 120 at almost the same rotational angle at a time when the right hook 134 and the left hook 136 finished twisting the wire W. At this occasion, the distal shaft 132 is maintained in the state of having moved forward relative to the screw shaft 120 by the biasing force of the compression spring 140, and thus the distal shaft 132 is relatively pulled out from the outer sleeve 124, and the right hook 134 and the left hook 136 start to open.

Thereafter, when the screw shaft 120 is rotated further in the clockwise direction, the outer sleeve 124 further moves backward relative to the screw shaft 120, resulting in the distal shaft 132 being completely pulled out from the outer sleeve 124, and the right hook 134 and the left hook 136 come to be in a completely opened state. After having reached this state, the distal shaft 132 moves backward relative to the screw shaft 120 together with the outer sleeve 124.

Thereafter, when the screw shaft 120 is rotated yet further in the clockwise direction, the outer sleeve 124 and the distal shaft 132 further move backward relative to the screw shaft 120, resulting in the most part of the screw shaft 120 being housed within the inner sleeve 122. At this occasion, if one of the short fins 124*a* has been in contact with the lower arm member 162 of the rotation restricting mechanism 156, the short fin 124*a* comes to make no contact with the lower arm member 162, and the rotation of the outer sleeve 124 is thereby allowed. At this occasion, the compression spring 140 and the bumper 138 are strongly compressed, and strong biasing force is applied from the compression spring 140 and the bumper 138. As a result of this, large frictional force is applied between the ball groove 120*c* of the screw shaft 120 and the ball 144 fitted in the ball hole of the inner sleeve 122, thus when the screw shaft 120 rotates, the outer sleeve 124 rotates together with the screw shaft 120 without moving backward relative to the screw shaft 120. When one of the long fins 124*b* makes contact with the lower arm member 162 of the rotation restricting mechanism 156 due to the rotation of the outer sleeve 124, the rotation of the outer sleeve 124 is again inhibited, and the outer sleeve 124 further moves backward. When the magnetic sensor 154 detects that the outer sleeve 124 has completely moved backward, the twisting mechanism 40 stops the rotation of the twisting motor 96. Due to this, the twisting mechanism 40 returns to its initial posture.

As shown in FIG. 1, when the user positions the rebar tying tool 2 such that the plural rebars R are arranged between the upper curl guide 60 and the lower curl guide 62 and pulls the trigger 7, the rebar tying tool 2 performs the series of operations of winding the wire W around the rebars R by the feeding mechanism 32, the guide mechanism 34, and the brake mechanism 36, and cutting and twisting the wire W wound around the rebars R by the cutting mechanism 38 and the twisting mechanism 40.

Figure 23:
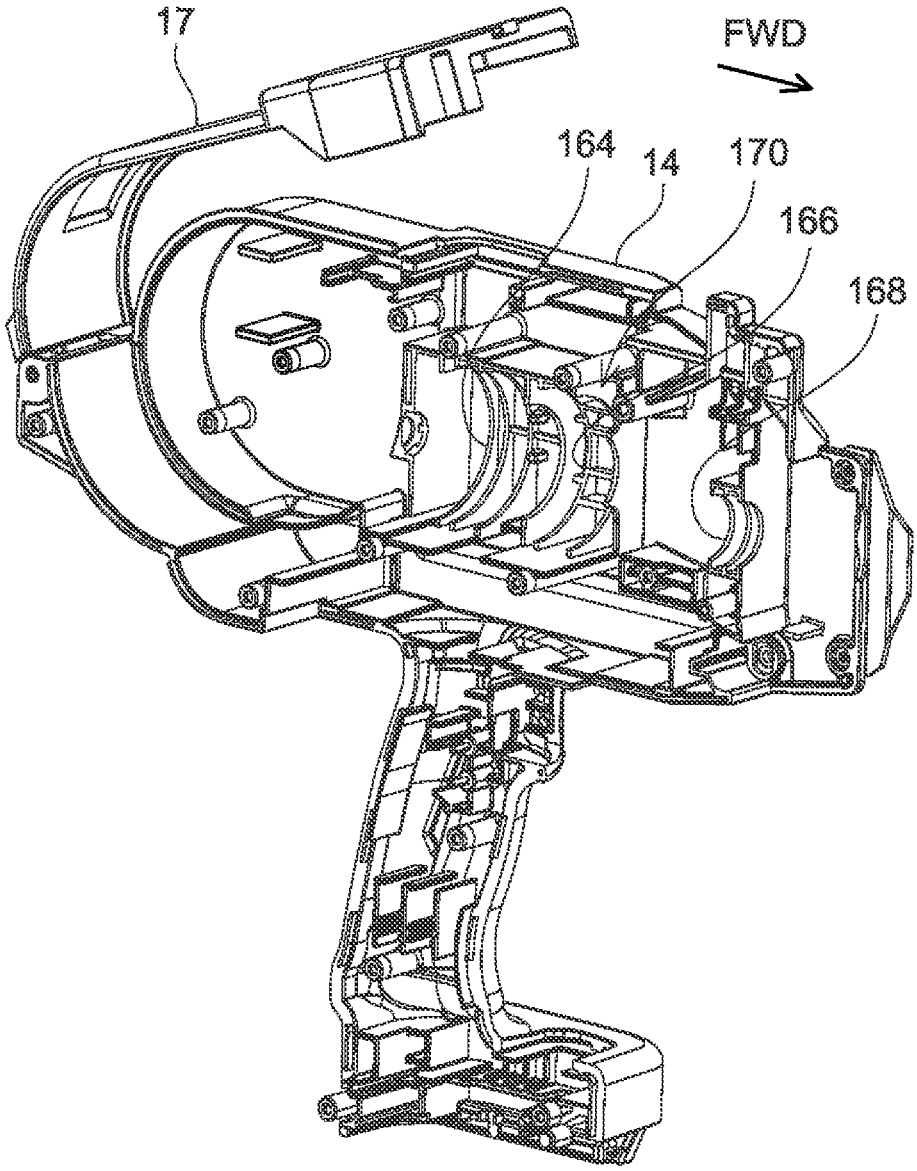
FIG. 23 is a perspective view showing an assembling work of the rebar tying tool 2 of the embodiment.
Figure 24:
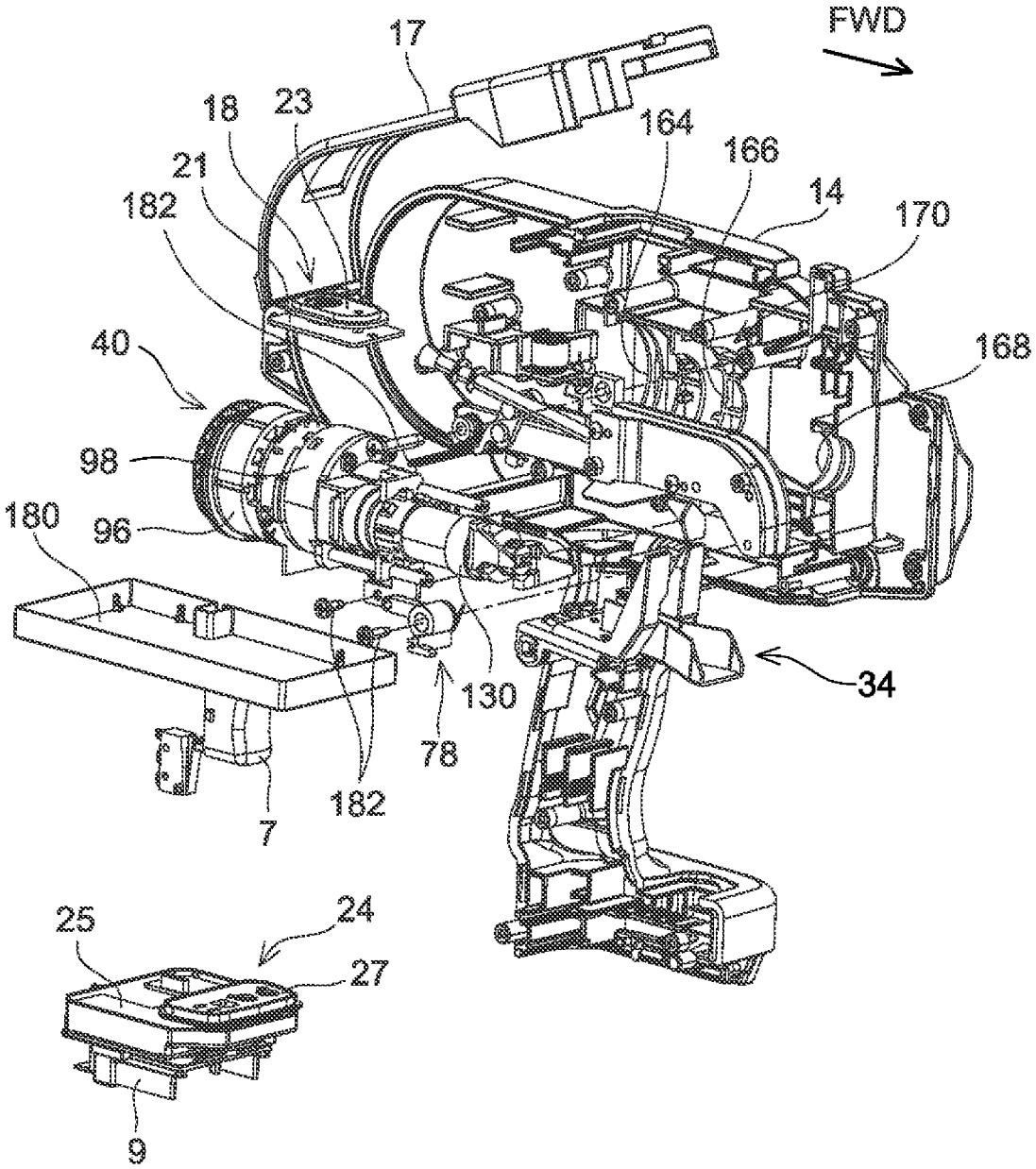
FIG. 24 is a perspective view showing the assembling work of the rebar tying tool 2 of the embodiment.
Figure 25:
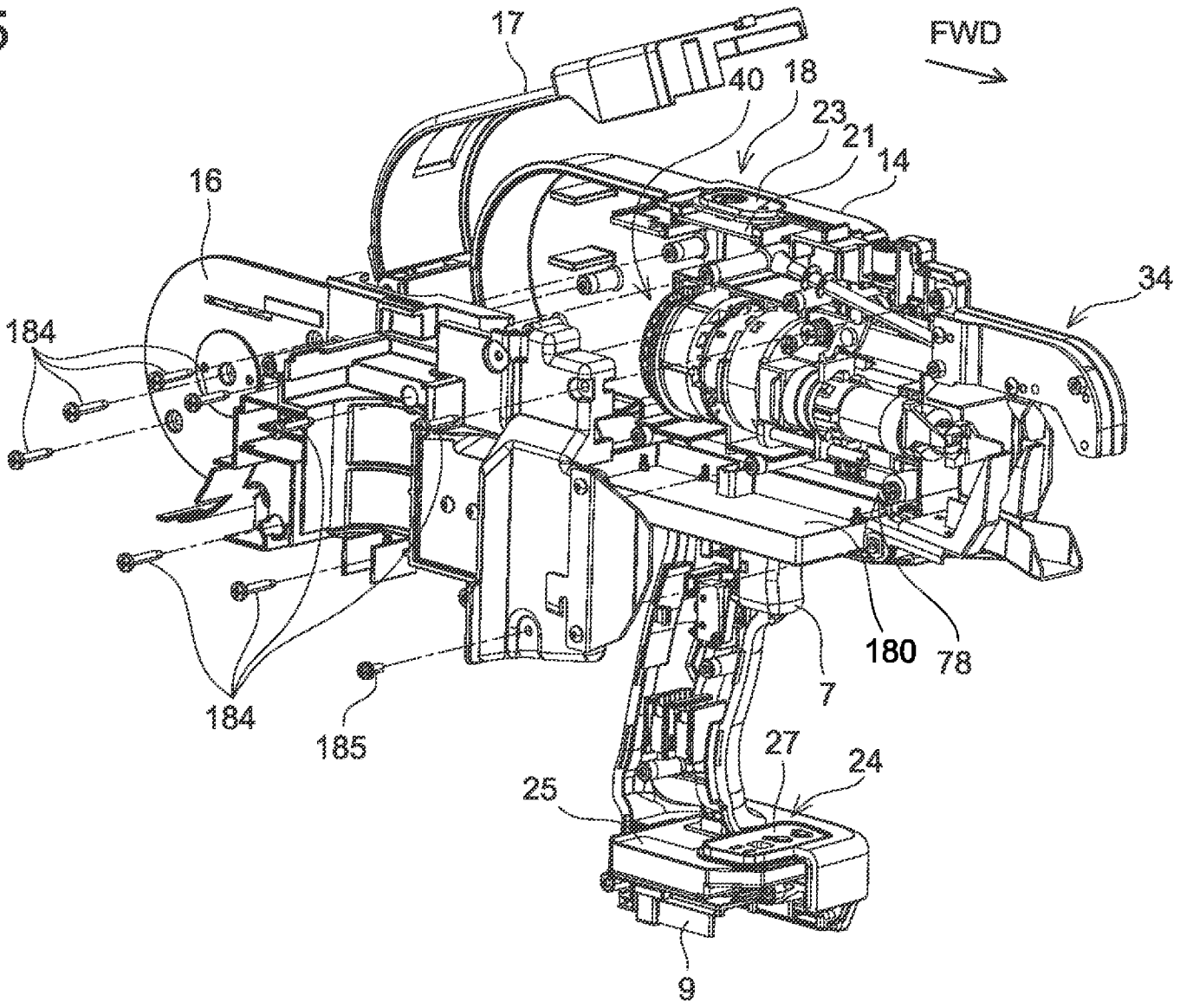
FIG. 25 is a perspective view showing the assembling work of the rebar tying tool 2 of the embodiment.
Figure 26:
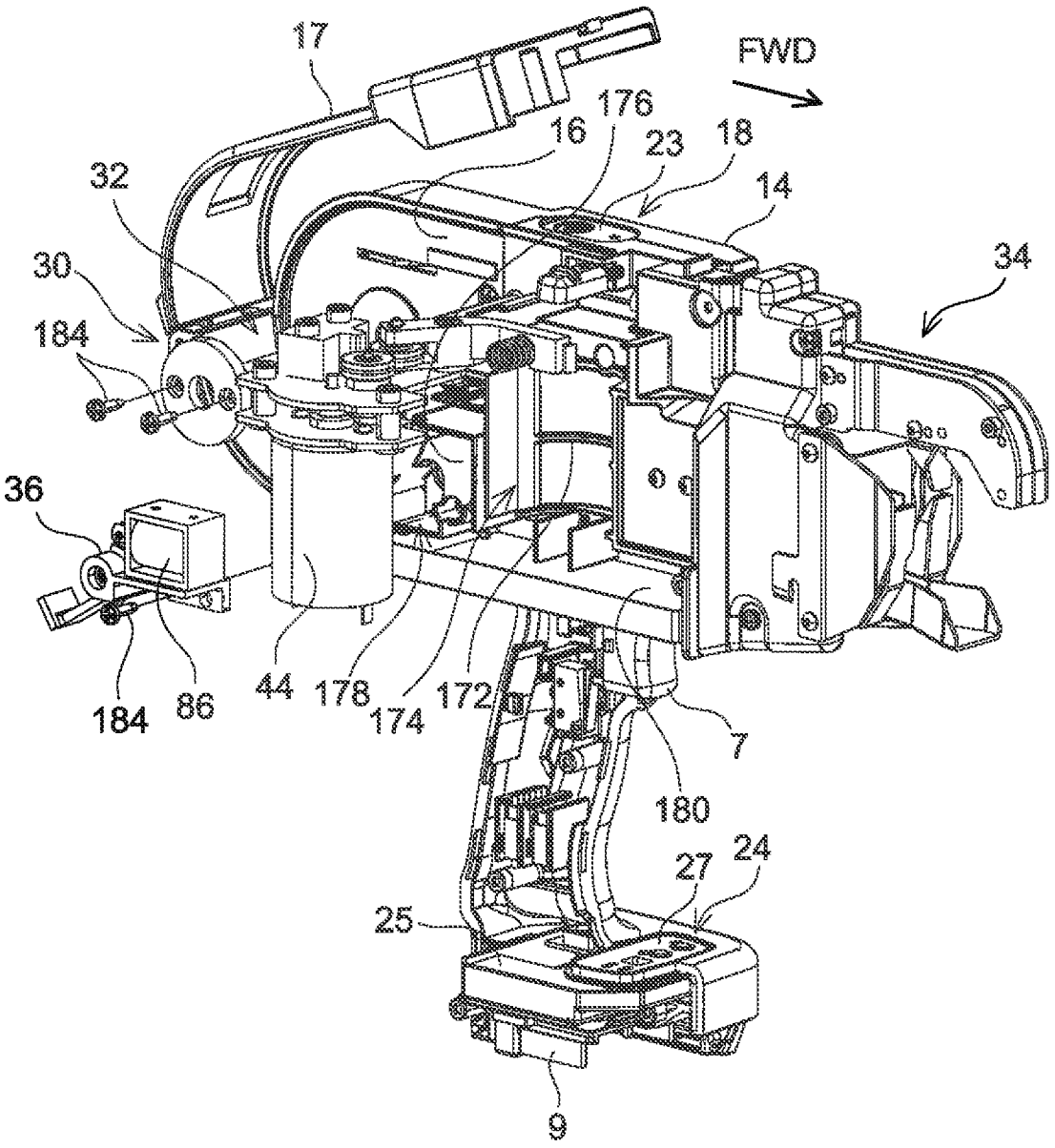
FIG. 26 is a perspective view showing the assembling work of the rebar tying tool 2 of the embodiment.
Figure 27:
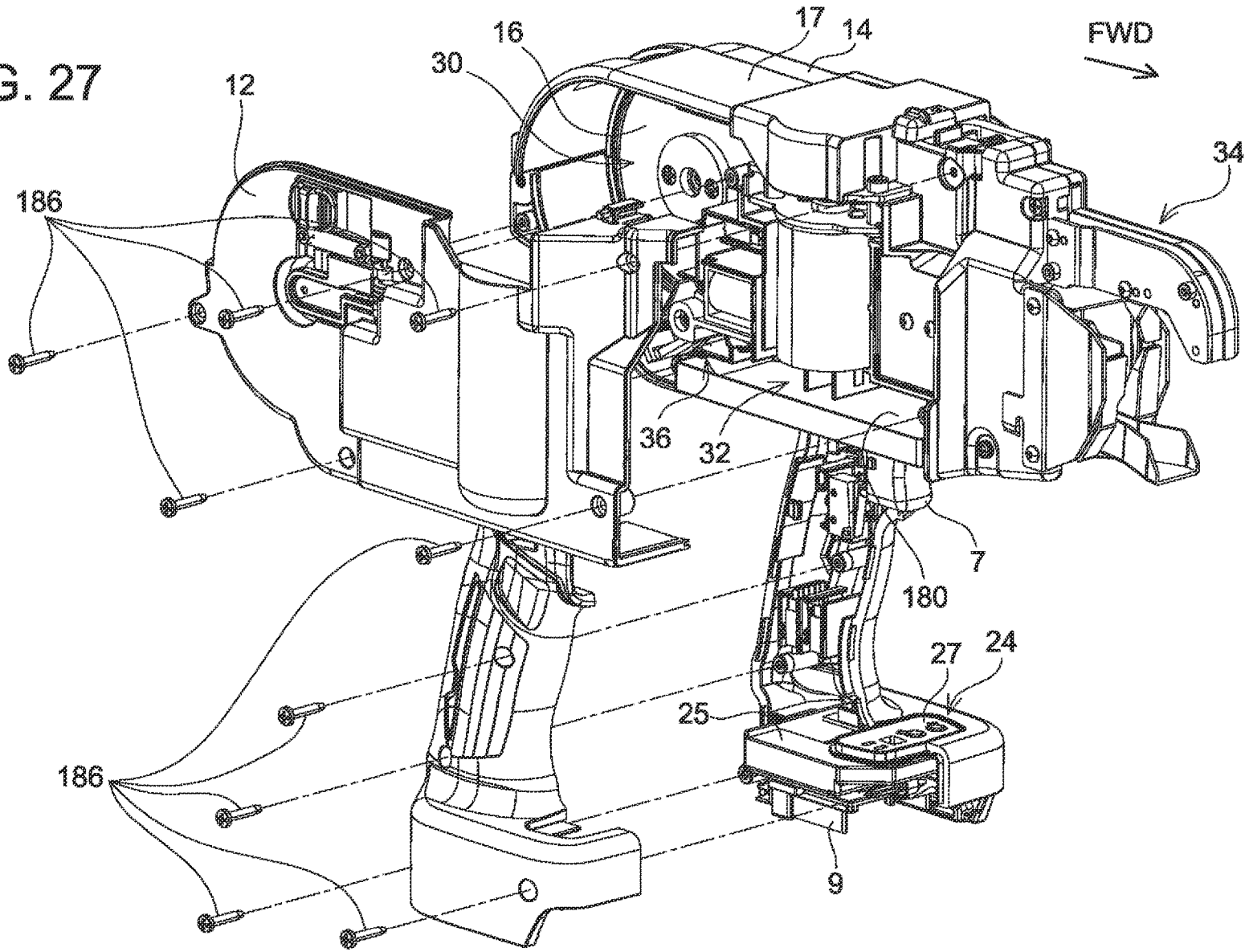
FIG. 27 is a perspective view showing the assembling work of the rebar tying tool 2 of the embodiment.

Hereinbelow, an assembling work of the rebar tying tool 2 will be described with reference to FIGS. 23 to 27. Notably, in FIGS. 23 to 27, connection wires and the like are not shown for easier view of the drawings. Firstly, as shown in FIG. 23, the cover 17 is installed onto the left outer housing 14. Then, as shown in FIG. 24, the trigger 7, the terminal 9, the first operation and display unit board 21 and the first switch plate 23 of the first operation and display unit 18, the second operation and display unit board 25 and the second switch plate 27 of the second operation and display unit 24, the guide mechanism 34, the cutting mechanism 38, the twisting mechanism 40, the state detection mechanism 78, the control board 180, and the like are installed onto the left outer housing 14. On an inner surface of the left outer housing 14, that is, on a surface facing the inner housing 16, a twisting mechanism retaining portion 170 which comprises a twisting motor retaining portion 164 for retaining the twisting motor 96, a first reduction mechanism retaining portion 166 for retaining the first reduction mechanism 98, and a supporting sleeve retaining portion 168 for retaining the supporting sleeve 130 is provided, and the twisting mechanism 40 is retained by the twisting mechanism retaining portion 170. Further, the guide mechanism 34, the cutting mechanism 38, and the state detection mechanism 78 are fixed to the left outer housing 14 by screws 182. At this occasion, wire connecting work for connecting the control board 180 with each of the trigger 7, the terminal 9, the first operation and display unit board 21, the second operation and display unit board 25, the twisting mechanism 40, and the state detection mechanism 78 is also performed. Thereafter, as shown in FIG. 25, the inner housing 16 is installed onto the left outer housing 14 using screws 184 and small screws 185. Thereafter, as shown in FIG. 26, the accommodating mechanism 30, the feeding mechanism 32, and the brake mechanism 36 are respectively installed onto the inner housing 16. On a surface of the inner housing 16 facing the right outer housing 12, a feeding mechanism retaining portion 174 which comprises a feeding motor retaining portion 172 for retaining the feeding motor 44 and a brake mechanism retaining portion 178 which comprises a solenoid retaining portion 176 for retaining the solenoid 86 are provided, the feeding mechanism 32 is retained by the feeding mechanism retaining portion 174, and the brake mechanism 36 is retained by the brake mechanism retaining portion 178. The accommodating mechanism 30 and the brake mechanism 36 are fixed to the inner housing 16 by the screws 184. At this occasion, wire connecting work for connecting each of the feeding mechanism 32 and the brake mechanism 36 with the control board 180 is also performed. Thereafter, as shown in FIG. 27, the right outer housing 12 is installed onto the left outer housing 14 and the inner housing 16 by screws 186, thereby the rebar tying tool 2 being assembled completely. As above, upon assembling the rebar tying tool 2, the respective constituent elements such as the twisting mechanism 40, the cutting mechanism 38, the guide mechanism 34, the feeding mechanism 32, the brake mechanism 36, and the like can be installed by work from one side of the rebar tying tool 2 without turning over the rebar tying tool 2. Therefore, the assembling work can easily be performed.

In the present embodiment, the control board 180 is disposed so as to extend across the inner housing 16, the part of the control board 180 is disposed on the one side as seen from the inner housing 16 (right outer housing 12 side), and another part of the control board 180 is disposed on the other side as seen from the inner housing 16 (left outer housing 14 side). Due to this, the wire connection between the feeding motor 44 of the feeding mechanism 32 and the control board 180 as well as the wire connection between the solenoid 86 of the brake mechanism 36 and the control board 180 can be performed in the space on the one side as seen from the inner housing 16 (right outer housing 12 side). Further, the wire connection between the twisting motor 96 of the twisting mechanism 40 and the control board 180 can be performed on the other side as seen from the inner housing 16 (left outer housing 14 side). By configuring as above, holes and connection terminals for passing the connection wires between the control board 180 and each of the feeding motor 44, the solenoid 86, and the twisting motor 96 do not need to be provided in the inner housing 16. Further, since the connection wires do not need to be passed from the one side to the other side of the inner housing 16, the assembly workability of the rebar tying tool 2 can be improved. Notably, as the control board 180, a feeding motor control board for controlling the feeding motor 44, a solenoid control board for controlling the solenoid 86, and a twisting motor control board for controlling the twisting motor 96 may be provided separately. In this case, if the feeding motor control board, the solenoid control board, and the twisting motor control board are configured so that a part of each of the boards is disposed on the one side as seen from the inner housing 16 (right outer housing 12 side), and another part of each of the boards is disposed on the other side as seen from the inner housing 16 (left outer housing 14 side), effects similar to the aforementioned effects can be achieved.

While specific examples of the present disclosure have been described above in detail, these examples are merely illustrative and place no limitation on the scope of the patent claims. The technology described in the patent claims also encompasses various changes and modifications to the specific examples described above. The technical elements explained in the present disclosure or drawings provide technical utility either independently or through various combinations. The present disclosure is not limited to the combinations described at the time the claims are filed. Further, the purpose of the examples illustrated by the present disclosure or drawings is to satisfy multiple objectives simultaneously, and satisfying any one of those objectives gives technical utility to the present disclosure.

What is claimed is:

1. A rebar tying tool having a front end in a front-back direction that is configured to receive rebars and an up-down direction that is transverse to the front-back direction, comprising:

a wire feeding mechanism;

a feeding motor configured to drive the wire feeding mechanism;

a wire twisting mechanism that is configured to receive wire from the wire feeding mechanism and twist the wire around the rebars;

a twisting motor configured to drive the wire twisting mechanism;

a reel chamber configured to house a reel of wire to supply to the wire feeding mechanism;

a housing that (1) houses the wire feeding mechanism, (2) forms part of the reel chamber, and (3) has an opening above the reel chamber in the up-down direction that is configured such that the reel can be inserted through the opening;

a hand grip below the reel chamber in the up-down direction;

a battery attachment portion below the hand grip in the up-down direction; and an openable cover that covers the opening when in a closed position, wherein the wire feeding mechanism includes:

a driving gear coupled to the feeding motor;

a driven gear that is configured to be selectively driven by the driving gear; and a releasing lever (1) to which the driven gear is rotatably attached and (2) that is configured to position the driven gear in a first position in which the driven gear engages the driving gear and a second position in which the driven gear is disengaged from the driving gear, and at least a part of the releasing lever is under the cover when the cover is in the closed position.

2. The rebar tying tool according to claim 1, wherein the cover is attached to the housing and has an open position.

3. The rebar tying tool according to claim 2, wherein the cover is rotatably attached to the housing and rotatable between the open position and the closed position.

4. The rebar tying tool according to claim 3, wherein the cover has an axis of rotation that is transverse to the up-down direction and the front-back direction.

5. The rebar tying tool according to claim 1, further comprising:

a main switch operable to switch power of the rebar tying tool on and off; and a main power LED that is configured to display the on/off state of the power;

wherein the main switch and the main power LED are lateral of the cover in a direction perpendicular to the up-down direction and the front-back direction.

6. The rebar tying tool according to claim 1, wherein the releasing lever extends forward of the cover in the front-back direction.

7. The rebar tying tool according to claim 1, wherein the cover covers the driving gear and the driven gear when the cover is in the closed position.

8. The rebar tying tool according to claim 1, wherein the twisting motor is in front of the reel chamber in the front-back direction.

9. The rebar tying tool according to claim 1, wherein the feeding motor is in front of the reel chamber in the front-back direction and beside the twisting motor in a direction transverse to the front-back direction and the up-down direction.

10. The rebar typing tool according to claim 1, wherein:

the wire feeding mechanism further includes a lock lever configured to retain the releasing lever in a position in which the releasing lever positions the driven gear in the first position; and the driving gear and the driven gear are configured such that the wire is fed between the driving gear and the driven gear when the driven gear is in the first position and is not fed between the driving gear and the driven gear when the driven gear is in the second position.

11. The rebar tying tool according to claim 10, wherein the releasing lever is biased to the position in which the driven gear is in the first position.

12. The rebar tying tool according to claim 11, wherein the lock lever is configured to selectively hold the releasing lever in the position in which the driven gear is in the first position.

13. The rebar tying tool according to claim 10, further comprising a guide member (1) configured to guide the wire supplied from the reel housed in the reel chamber to the driving gear and the driven gear and (2) in front of the reel chamber in the front-rear direction;

wherein the driving gear and the driven gear are in front of the guiding member in the front-back direction.

14. The rebar tying tool according to claim 1, further comprising a brake mechanism that is configured to selectively stop rotation of the reel.

15. The rebar tying tool according to claim 14, wherein:

the brake mechanism and the feeding mechanism are configured such that the brake mechanism stops rotation of the reel when the feeding mechanism stops.

* * * * *